US010985002B2

(12) United States Patent
Patkin

(10) Patent No.: US 10,985,002 B2
(45) Date of Patent: Apr. 20, 2021

(54) IONIZATION SOURCES AND METHODS AND SYSTEMS USING THEM

(71) Applicant: PERKINELMER HEALTH SCIENCES, INC., Waltham, MA (US)

(72) Inventor: Adam Patkin, Hamden, CT (US)

(73) Assignee: PerkinElmer Health Sciences, Inc., Waltham, MA (US)

( * ) Notice: Subject to any disclaimer, the term of this patent is extended or adjusted under 35 U.S.C. 154(b) by 0 days.

(21) Appl. No.: 16/438,342

(22) Filed: Jun. 11, 2019

(65) Prior Publication Data

US 2020/0395204 A1 Dec. 17, 2020

(51) Int. Cl.
*H01J 49/00* (2006.01)
*H01J 49/08* (2006.01)

(52) U.S. Cl.
CPC ..... *H01J 49/08* (2013.01); *H01J 49/0027* (2013.01)

(58) Field of Classification Search
CPC .. H01J 49/00; H01J 49/02; H01J 49/10; H01J 49/03; H01J 49/063; H01J 49/105; H01J 49/14; H01J 49/147
USPC ..... 250/281, 282, 288
See application file for complete search history.

(56) References Cited

U.S. PATENT DOCUMENTS

2005/0258354 A1* 11/2005 Baba ..... H01J 49/0095 250/281
2012/0091330 A1* 4/2012 Coon ..... H01J 49/0045 250/282
2014/0361163 A1* 12/2014 Taniguchi ..... H01J 49/022 250/287
2019/0006164 A1* 1/2019 Yoshinari ..... H01J 49/063

* cited by examiner

*Primary Examiner* — Jason L McCormack
(74) *Attorney, Agent, or Firm* — Rhodes IP PLC; Christopher R Rhodes

(57) ABSTRACT

Certain configurations of an ionization source comprising a multipolar rod assembly are described. In some examples, the multipolar rod assembly can be configured to provide a magnetic field and a radio frequency field into an ion volume formed by a substantially parallel arrangement of rods of the multipolar rod assembly. The ionization source may also comprise an electron source configured to provide electrons into the ion volume of the multipolar rod assembly to ionize analyte introduced into the ion volume. Systems and methods using the ionization source are also described.

35 Claims, 16 Drawing Sheets

IONIZATION SOURCES AND METHODS AND SYSTEMS USING THEM

TECHNOLOGICAL FIELD

Certain configurations of ionization sources are described. More particular, an ionization source comprising a rod assembly that provides a magnetic field and a radio frequency field is disclosed.

BACKGROUND

Analyte chemical species in samples are ionized prior to detection by mass spectrometry. Ionization efficiency is often low in existing ionization sources, which limits trace detection of many analytes.

SUMMARY

Certain aspects are described of ionization sources that comprise a rod assembly that can provide a magnetic field and a radio frequency (RF) field. In some instances, the rod assembly may comprise four, six, eight, ten, twelve or more rods. Each rod can be magnetized or magnetizable. The rod assembly can be present in combination with other components to provide one or more ionization sources that can be used to ionize analyte species.

In an aspect, an ionization source comprises a multipolar rod assembly configured to provide a magnetic field and a radio frequency field into an ion volume formed by a substantially parallel arrangement of rods of the multipolar rod assembly, and an electron source configured to provide electrons into the ion volume of the multipolar rod assembly to ionize analyte introduced into the ion volume.

In certain examples, the ionization source comprises an optional enclosure surrounding the multipolar rod assembly or inside of the multipolar rod assembly, wherein the enclosure comprises an aperture fluidically coupled to the electron source at an inlet to permit the electrons from the electron source to enter into the ion volume through the aperture at the inlet. In other examples, the ionization source may comprise an ionization block comprising an entrance aperture and an exit aperture, wherein a longitudinal axis of each rod of the multipolar rod assembly is substantially parallel with a longitudinal axis of the ionization block, and wherein the entrance aperture is fluidically coupled to the ion volume to permit introduction of electrons through the entrance aperture and into the ion volume to ionize analyte within the ion volume, and wherein the exit aperture is configured to permit exit of ionized analyte from the ionization block.

In some examples, the ionization source may comprise one or more of an electron repeller arranged co-linearly with the electron source and/or an electron reflector arranged co-linearly with the electron source and configured to receive electrons from the electron source.

In other examples, the multipolar rod assembly comprises at least four rods. For example, the multipolar rod assembly comprises one of a quadrupolar rod assembly, a hexapolar rod assembly, an octopolar rod assembly, a decapolar rod assembly or a dodecapolar rod assembly.

In some embodiments, each rod of the multipolar rod assembly comprises a magnetizable material, and wherein each rod is magnetized and provides a similar field strength. In other embodiments, each rod of the multipolar rod assembly comprises a magnetizable material, and wherein a rod of the multipolar assembly, e.g., at least one rod, provides a different field strength than another rod of the multipolar assembly when the rod and the another rod are magnetized.

In some examples, the electron source comprises a filament, a field emitter or other sources of electrons.

In certain examples, the multipolar rod assembly comprises a plurality of rods. For example, the multipolar rod assembly is configured to operate in a quadrupolar mode using four of the plurality of rods, to operate in a hexapolar mode using six of the plurality of rods, and to operate in an octopolar mode using eight of the plurality of rods.

In some embodiments, at least one rod of the multipolar assembly comprises a different length than another rod of the multipolar assembly. In other examples, at least one rod of the multipolar rod assembly is not parallel to the other rods. In some examples, a cross-sectional width of at least one rod of the multipolar rod assembly varies along a length of the at least one rod. In other examples, a shape of each rod of the multipolar rod assembly is independently conical, round, tapered, square, rectangular, triangular, trapezoidal, parabolic, hyperbolic or other geometric shape. In some embodiments, at least two rods of the multipolar rod assembly comprise different shapes.

In another aspect, a mass spectrometer comprises an ionization source comprising a multipolar rod assembly configured to provide a magnetic field and a radio frequency field into an ion volume formed by a substantially parallel arrangement of rods of the multipolar rod assembly, and an electron source fluidically coupled to the ion volume of the multipolar rod assembly to provide electrons from the electron source into the ion volume to ionize analyte introduced into the ion volume. The mass spectrometer may also comprise a mass analyzer fluidically coupled to the ion volume and configured to receive ionized analyte exiting the ion volume.

In some embodiments, the mass spectrometer comprises ion optics positioned between the multipolar rod assembly of the ionization source and an inlet of the mass analyzer. In additional examples, the mass spectrometer comprises a processor electrically coupled to a power source, wherein the processor is configured to provide a radio frequency voltage to rods of the multipolar rod assembly from the power source to provide the radio frequency field. In some instances, the processor is further configured to provide a DC voltage to rods of the multipolar rod assembly, though an AC voltage or RF voltage (or both) can also be provided if desired.

In some examples, the processor provides the radio frequency voltage to four rods of the multipolar assembly in a quadrupolar mode, to six rods of the multipolar assembly in a hexapolar mode, and to eight rods of the multipolar assembly in an octopolar mode. In other instances, the rods can be paired or grouped such that two or more rods function as a single rod. In some embodiments, a radio frequency voltage is provided to rods of the multipolar rod assembly using analog control.

In some examples, the multipolar rod assembly comprises one of a quadrupole rod assembly, a hexapolar rod assembly, an octopolar rod assembly, a decapolar rod assembly or a dodecapolar rod assembly. In certain embodiments, each rod of the multipolar rod assembly comprises a magnetizable material, and wherein each rod is magnetized and provides a similar field strength. In other examples, each rod of the multipolar rod assembly comprises a magnetizable material, and wherein at least one rod of the multipolar assembly provides a different field strength than another rod of the multipolar assembly.

In some embodiments, at least one rod of the multipolar assembly comprises a different length than another rod of the multipolar assembly. In other embodiments, a cross-sectional width of at least one rod of the multipolar rod assembly varies along a length of the at least one rod. In some examples, a shape of each rod of the multipolar rod assembly is independently conical, round, tapered, square, rectangular, triangular, trapezoidal, parabolic, hyperbolic or other geometric shape.

In other embodiments, the mass spectrometer may be coupled to a chromatography system fluidically coupled to the ion volume to introduce a sample from the chromatography system into the ion volume. In other embodiments, the mass spectrometer comprises a detector coupled to the mass analyzer. In additional examples, the mass spectrometer comprises a data analysis system comprising a processor and a non-transitory computer readable medium having instructions stored thereon, wherein the instructions, when executed by the processor, control a voltage provided to rods of the multipolar rod assembly.

In an additional aspect, a method of ionizing an analyte comprises introducing the analyte into an ion volume formed from a substantially parallel arrangement of rods of a multipolar rod assembly, wherein the ion volume is configured to receive electrons from an electron source, and wherein the multipolar rod assembly provides a magnetic field and a radio frequency field into the ion volume to increase ionization efficiency of the analyte using the received electrons from the electron source.

In some examples, the method comprises selecting a radio frequency voltage provided to the multipolar rod assembly to constrain ions produced within the ion volume to an inner area of the ion volume. In other examples, at least one rod of the multipolar rod assembly comprises a different magnetizable material than another rod of the multipolar rod assembly. In different embodiments, the method comprises providing a radio frequency voltage to four rods of the multipolar rod assembly to provide a quadrupolar field within the ion volume. In some examples, each rod is magnetized to a similar field strength or wherein at least one rod is magnetized to a different field strength.

In another aspect, a method of assembling an ionization source comprising a multipolar rod assembly is described. A plurality of rods can be arranged substantially parallel to each other to form an ion volume from the arrangement of the rods. The ion volume is configured to receive electrons from an electron source at first end of the multipolar assembly and provide ionized analytes from the ion volume to a mass analyzer at a second end of the multipolar rod assembly. Each rod of the multipolar rod assembly is magnetized after each rod is assembled to form the ion volume of the multipolar rod assembly. In some examples, at least one rod of the multipolar rod assembly is magnetized to a different field strength than a field strength of another rod of the multipolar rod assembly In an additional aspect, a method of assembling an ionization source comprising a multipolar rod assembly, wherein a plurality of rods are arranged substantially parallel to each other to form an ion volume from the arrangement of the rods, wherein the ion volume is configured to receive electrons from an electron source at first end of the multipolar assembly and provide ionized analytes from the ion volume to a mass analyzer at a second end of the multipolar rod assembly, wherein each rod of the multipolar rod assembly is magnetized before each rod is assembled to form the ion volume of the multipolar rod assembly. In some examples, at least one rod of the multipolar rod assembly is magnetized to a different field strength than a field strength of another rod of the multipolar rod assembly.

Additional aspects, examples, embodiments and configurations are also described.

BRIEF DESCRIPTION OF THE SEVERAL VIEWS OF THE DRAWINGS

Certain illustrations of the technology disclosed herein are described with reference to the accompanying figures in which.

DETAILED DESCRIPTION

Certain embodiments are described for ionization sources. The exact number of rods, the shape of the rods and the number and type of other components present in the ionization sources can vary. In addition, the exact system or device that may comprise the ionization source can vary, and the ionization source is typically used with a mass spectrometer and a chromatography system. Illustrations of ionization sources, systems including them and methods using them are provided to facilitate a better understanding of the technology and are not intended to limit the exact arrangement or components which may be present in an ionization source.

In certain configurations, the ionization sources described herein generally comprise a multipolar rod assembly and an electron source. The multipolar rod assembly can be configured to provide a magnetic field and a radio frequency (RF) field using the rod assembly. For example, the rods can be arranged substantially parallel to each other (or arranged in other manners) with an ion volume formed by the rod arrangement. Electrons from the electron source can be provided to the ion volume and used to ionize one or more analytes introduced into the ion volume. As described in more detail below, the rods can be used individually or can be paired or grouped such that two or more rods function as a single rod in the multipolar rod assembly. The electrons typically are introduced in a direction which is substantially parallel to a longitudinal axis of the rods, though the electrons can be introduced at other angles and in other directions if desired. While not wishing to be bound by any one particular theory or mechanism of action, the magnetic field primarily constrains the electron motion to the center region of the rod array, and the RF field primarily constrains the resulting ions to the center of the rod array. In some configurations, the magnetic and RF fields can be used to ionize analyte sample without filtering or selecting any produced ions using the ionization source.

Without wishing to be bound by any one configuration, the magnetic field component from the rods can be used to constrain electrons from the electron source to travel down the center of the rod array in the ionization source, and the RF field component can be used to constrain ions produced within the ionization source. In other instances, however, the field strengths of the magnetic and RF fields can be selected such that the magnetic field can constrain the ions, and the RF fields can constrain the electrons.

Figure 1:
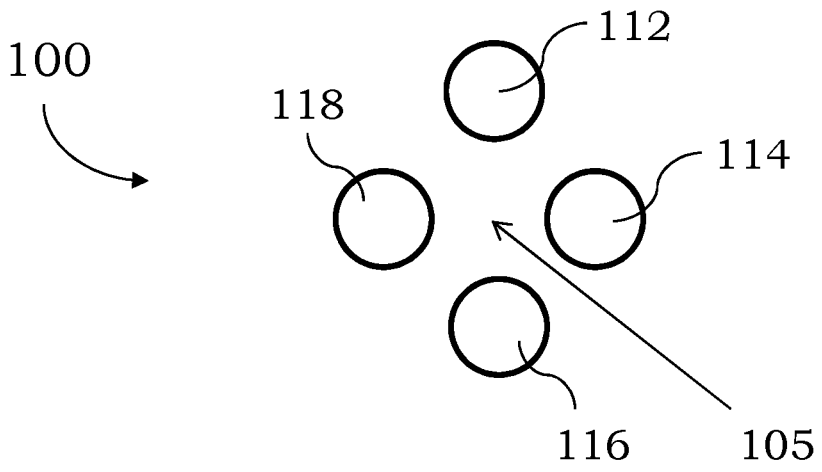
FIG. 1 is an illustration of a multipole rod assembly comprising four rods, in accordance with some examples.

In some examples, the ionization sources described herein may comprise four rods in a multipolar rod assembly 100 as shown in the top view of FIG. 1. While the rods are shown as having a circular cross-section in many figures herein, this shape is provide merely for convenience of illustration. The exact shape of the rods can be varied, as noted in more detail below, and can be tapered, different or may otherwise be non-circular and/or non-symmetric along a length and/or width of the rod. The rods 112, 114, 116 and 118 each may provide a magnetic field into an ion volume 105 formed by the rod assembly 100 and may also provide a radio frequency field into the ion volume 105. For example, each of the rods 112, 114, 116 and 118 may be magnetic or magnetizable to provide the magnetic field within the ion volume 105. In some configurations, each of the rods 112, 114, 116 and 118 may comprise a material which can be permanently magnetized or magnetized for at least some period. Each of the rods 112, 114, 116 and 118 may also be electrically coupled to a radio frequency generator so each rod provides a radio frequency field into the ion volume 105. Each of the rods 112, 114, 116 and 118 may be electrically coupled to a common radio frequency generator or may be electrically coupled to a respective radio frequency generator. Alternatively, any two or more rods can be electrically coupled to a radio frequency generator. The radio frequency field and the magnetic field each are provided by the rods 112, 114, 116 and 118. This arrangement can simplify the ionization sources described herein and permits, if desired, the omission of permanent magnets that are typically present external to an ionization chamber of existing ionization sources.

Figure 2:
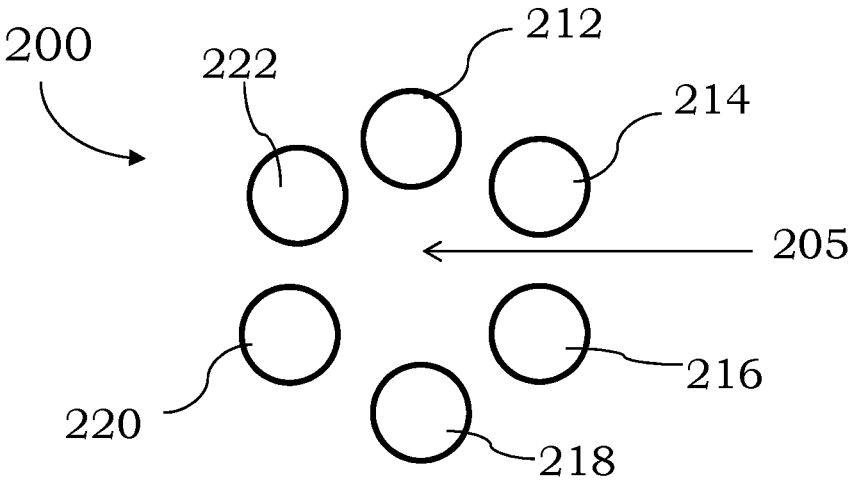
FIG. 2 is an illustration of a multipole rod assembly comprising six rods, in accordance with certain examples.

In some examples, the ionization sources described herein may comprise six rods in a multipolar rod assembly 200 as shown in the top view of FIG. 2. The rods 212, 214, 216, 218, 220 and 222 each may provide a magnetic field into an ion volume 205 formed by the rod assembly 200 and may also provide a radio frequency field into the ion volume 205. For example, each of the rods 212, 214, 216, 218, 220 and 222 may be magnetic or magnetizable to provide the magnetic field within the ion volume 205. In some configurations, each of the rods 212, 214, 216, 218, 220 and 222 may comprise a material which can be permanently magnetized or magnetized for at least some period. Each of the rods 212, 214, 216, 218, 220 and 222 may also be electrically coupled to a radio frequency generator so each rod provides a radio frequency field into the ion volume 205. Each of the rods 212, 214, 216, 218, 220 and 222 may be electrically coupled to a common radio frequency generator or may be electrically coupled to a respective radio frequency generator. Alternatively, any two or more of the rods 212, 214, 216, 218, 220 and 222 can be electrically coupled to a radio frequency generator. The radio frequency field and the magnetic field each are provided by the rods 212, 214, 216, 218, 220 and 222.

Figure 3:
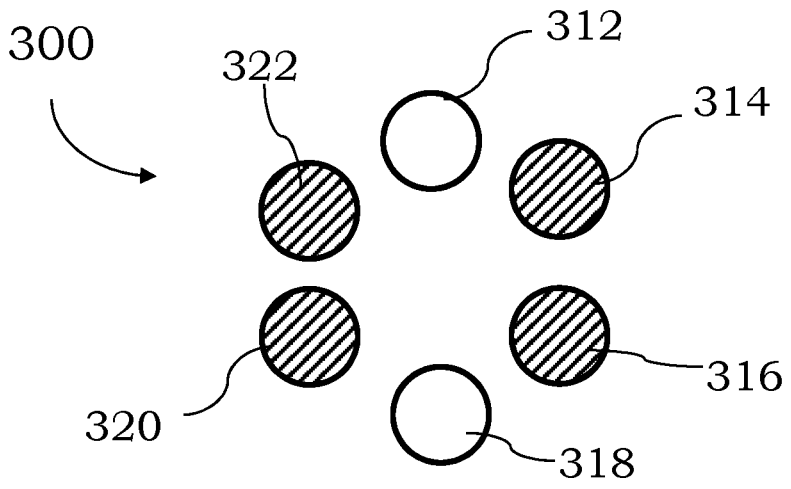
FIG. 3 is an illustration of a multipole rod assembly comprising six rods where four rods are used, in accordance with some examples.

In certain embodiments where a rod assembly comprises six rods, it may be desirable to use only four of the rods to ionize analyte. Referring to FIG. 3, a rod assembly 300 is shown comprising rods 312, 314, 316, 318, 320 and 322. As shown by the shading, only rods 314, 316, 320 and 322 are active or used during ionization. Four different rods could instead be active or used if desired. The two remaining rods may be switched on or activated at some period during ionization to change the fields within the rod assembly 300. For example, a radio frequency field from only four rods can be used during ionization for a first period, and then a radio frequency field from all six rods 312, 314, 316, 318, 320 and 322 can be used for a second period or for different analytes. If desired, the RF field provided by two of the rods can be pulsed or switched on and off.

Figure 4:
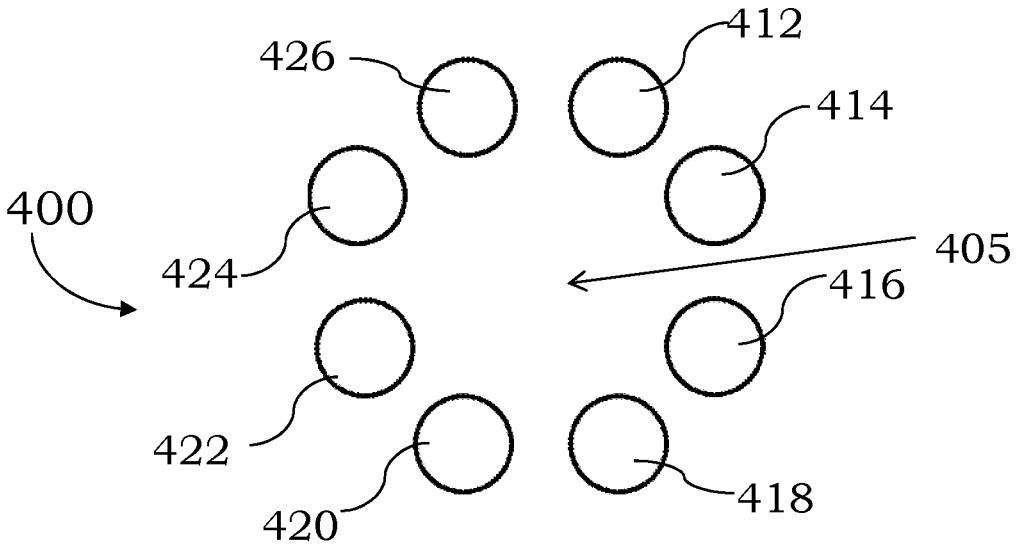
FIG. 4 is an illustration of a multipole rod assembly comprising eight rods, in accordance with some embodiments.

In certain configurations, the ionization sources described herein may comprise eight rods in a multipolar rod assembly 400 as shown in the top view of FIG. 4. The rods 412, 414, 416, 418, 420, 422, 424 and 426 each may provide a magnetic field into an ion volume 405 formed by the rod assembly 400 and may also provide a radio frequency field into the ion volume 405. For example, each of the rods 412, 414, 416, 418, 420, 422, 424 and 426 may be magnetic or magnetizable to provide the magnetic field within the ion volume 405. In some configurations, each of the rods 412, 414, 416, 418, 420, 422, 424 and 426 may comprise a material which can be permanently magnetized or magnetized for at least some period. Each of the rods 412, 414, 416, 418, 420, 422, 424 and 426 may also be electrically coupled to a radio frequency generator so each rod provides a radio frequency field into the ion volume 405. Each of the rods 412, 414, 416, 418, 420, 422, 424 and 426 may be electrically coupled to a common radio frequency generator or may be electrically coupled to a respective radio frequency generator. Alternatively, any two or more of the rods 412, 414, 416, 418, 420, 422, 424 and 426 can be electrically coupled to a radio frequency generator. The radio frequency field and the magnetic field each are provided by the rods 412, 414, 416, 418, 420, 422, 424 and 426. This arrangement can simplify the ionization sources described herein and permits, if desired, the omission of permanent magnets that are typically present external to an ionization chamber of existing ionization sources.

Figure 5:
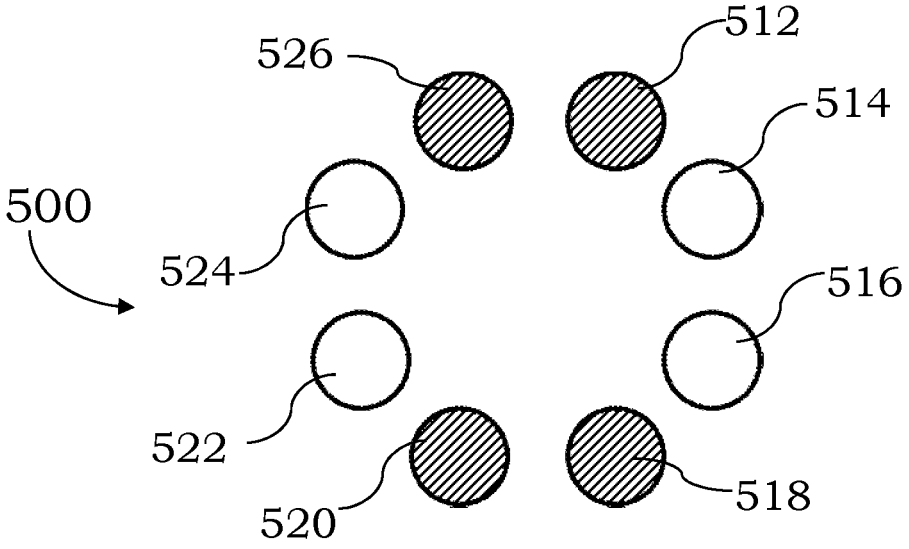
FIG. 5 is an illustration of a multipole rod assembly comprising eight rods where four rods are used, in accordance with certain embodiments.

In certain embodiments where a rod assembly comprises eight rods, it may be desirable to use only four of the rods to ionize analyte. Referring to FIG. 5, a rod assembly 500 is shown comprising rods 512, 514, 516, 518, 520, 522, 524 and 526. As shown by the shading in FIG. 5, only rods 512, 518, 520 and 526 are active or used during ionization. Four different rods could instead be active if desired. For example, every other rod could be active if desired. The four remaining rods may be switched on or activated at some period during ionization to change the fields within the rod assembly 500. For example, a radio frequency field from only four rods can be used during ionization for a first period, and then a radio frequency field from all eight rods 512, 514, 516, 518, 520, 522, 524 and 526 (or six of the rods) can be used for a second period or for different analytes. If desired, the RF field provided by four of the rods can be pulsed or switched on and off.

Figure 6:
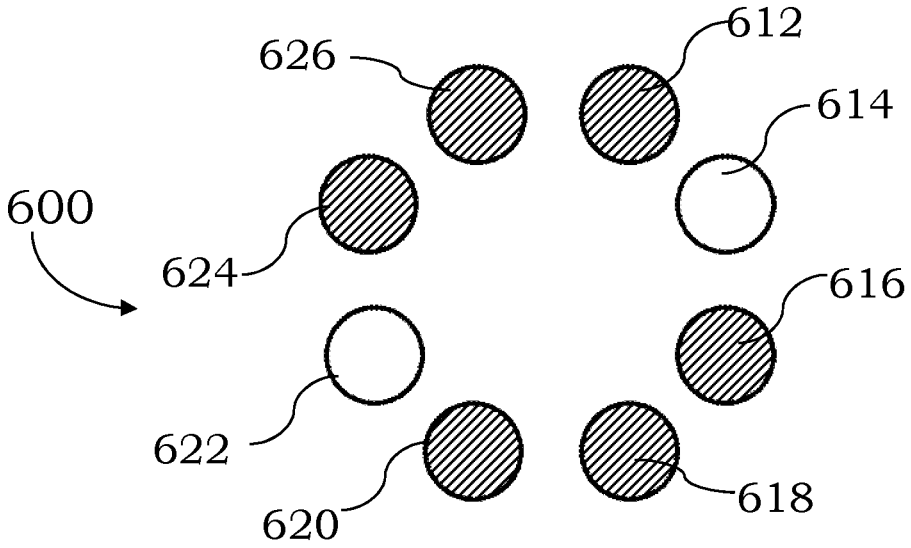
FIG. 6 is an illustration of a multipole rod assembly comprising eight rods where six rods are used, in accordance with certain embodiments.

In certain examples where a rod assembly comprises eight rods, it may be desirable to use only four of the rods to ionize analyte. Referring to FIG. 6, a rod assembly 600 is shown comprising rods 612, 614, 616, 618, 620, 622, 624 and 626. As shown by the shading in FIG. 6, only rods 612, 616, 618, 620, 624 and 626 are active or used during ionization. Six different rods could be active if desired. The two remaining rods may be switched on or activated at some period during ionization to change the fields within the rod assembly 600. For example, a radio frequency field from only six rods can be used during ionization for a first period, and then a radio frequency field from all eight rods 612, 614, 616, 618, 620, 622, 624 and 626 can be used for a second period or for different analytes. If desired, the RF field provided by two or four of the rods can be pulsed or switched on and off.

Figure 7:
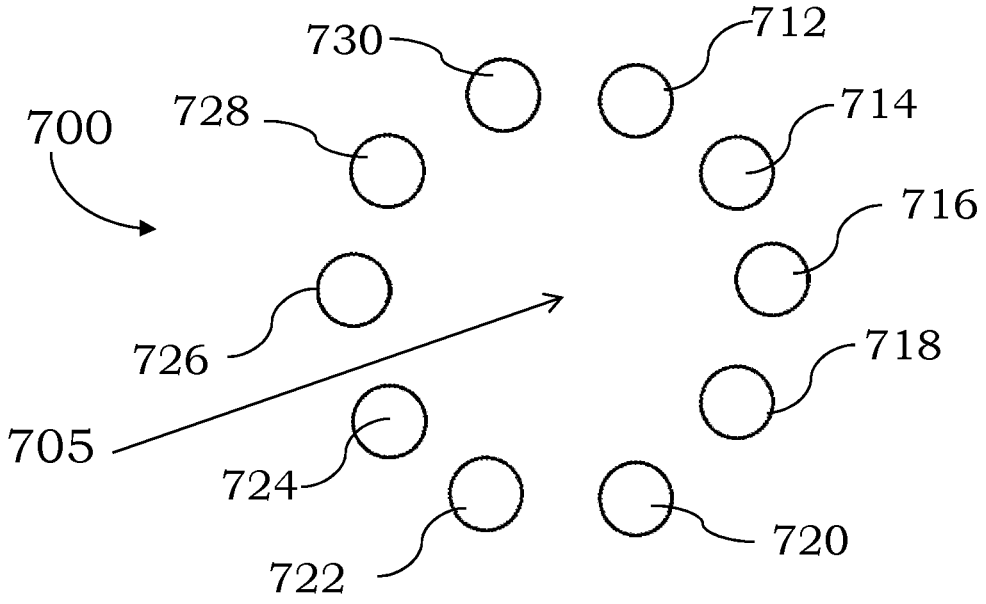
FIG. 7 is an illustration of a multipole rod assembly comprising ten rods, in accordance with certain examples.

In certain examples, the ionization sources described herein may comprise ten rods in a multipolar rod assembly 700 as shown in the top view of FIG. 7. The rods 712, 714, 716, 718, 720, 722, 724, 726, 728 and 730 each may provide a magnetic field into an ion volume 705 formed by the rod assembly 700 and may also provide a radio frequency field into the ion volume 705. For example, each of the rods 712, 714, 716, 718, 720, 722, 724, 726, 728 and 730 may be magnetic or magnetizable to provide the magnetic field within the ion volume 705. In some configurations, each of the rods 712, 714, 716, 718, 720, 722, 724, 726, 728 and 730 may comprise a material which can be permanently magnetized or magnetized for at least some period. Each of the rods 712, 714, 716, 718, 720, 722, 724, 726, 728 and 730 may also be electrically coupled to a radio frequency generator so each rod provides a radio frequency field into the ion volume 705. Each of the rods 712, 714, 716, 718, 720, 722, 724, 726, 728 and 730 may be electrically coupled to a common radio frequency generator or may be electrically coupled to a respective radio frequency generator. Alternatively, any two or more of the rods 712, 714, 716, 718, 720, 722, 724, 726, 728 and 730 can be electrically coupled to a radio frequency generator. The radio frequency field and the magnetic field each are provided by the rods 712, 714, 716, 718, 720, 722, 724, 726, 728 and 730. This arrangement can simplify the ionization sources described herein and permits, if desired, the omission of permanent magnets that are typically present external to an ionization chamber of existing ionization sources.

Figure 8:
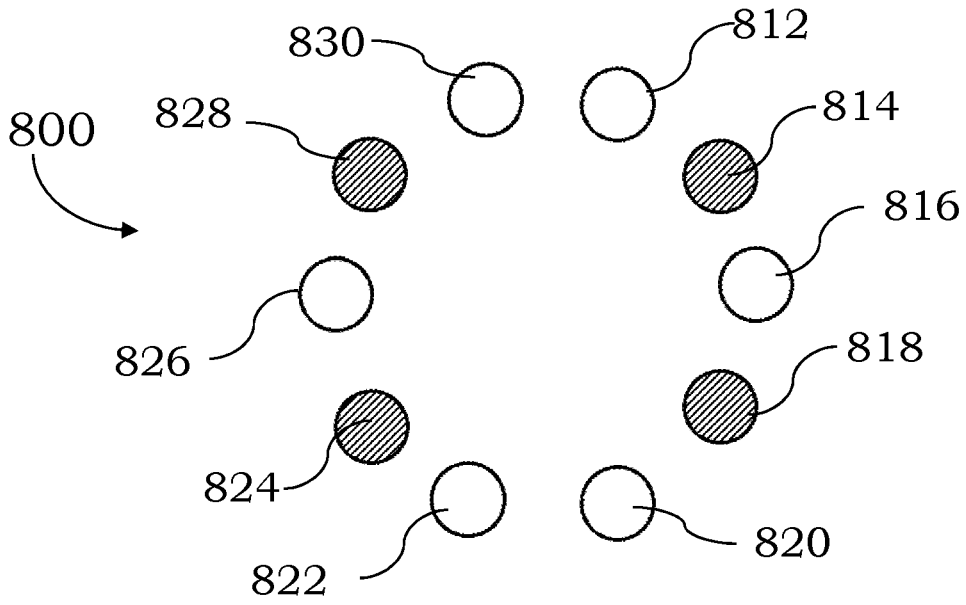
FIG. 8 is an illustration of a multipole rod assembly comprising ten rods where four rods are used, in accordance with some examples.

In certain examples where a rod assembly comprises ten rods, it may be desirable to use only four of the rods to ionize analyte. Referring to FIG. 8, a rod assembly 800 is shown comprising rods 812, 814, 816, 818, 820, 822, 824, 826, 828 and 830. As shown by the shading in FIG. 8, only rods 814, 818, 824 and 828 are active or used during ionization. Four other rods could be active or used if desired. The six remaining rods may be switched on or activated at some period during ionization to change the fields within the rod assembly 800. For example, a radio frequency field from only four rods can be used during ionization for a first period, and then a radio frequency field from all ten rods 812, 814, 816, 818, 820, 822, 824, 826, 828 and 830 can be used for a second period or for different analytes. If desired, the RF field provided by two or four or six of the rods can be pulsed or switched on and off.

Figure 9:
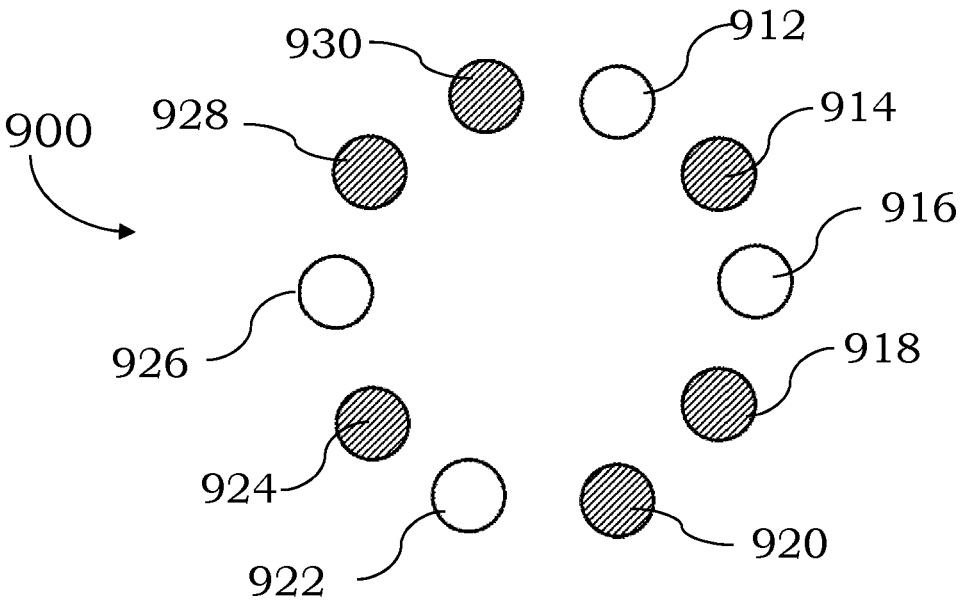
FIG. 9 is an illustration of a multipole rod assembly comprising ten rods where six rods are used, in accordance with certain embodiments.

In certain embodiments where a rod assembly comprises ten rods, it may be desirable to use only six of the rods to ionize analyte. Referring to FIG. 9, a rod assembly 900 is shown comprising rods 912, 914, 916, 918, 920, 922, 924, 926, 928 and 930. As shown by the shading in FIG. 9, only rods 914, 918, 920, 924, 928 and 930 are active or used during ionization. Six other rods could instead be active or used if desired. The four remaining rods may be switched on or activated at some period during ionization to change the fields within the rod assembly 900. For example, a radio frequency field from only six rods can be used during ionization for a first period, and then a radio frequency field from all ten rods 912, 914, 916, 918, 920, 922, 924, 926, 928 and 930 can be used for a second period or for different analytes. If desired, the RF field provided by two or four of the rods can be pulsed or switched on and off.

Figure 10:
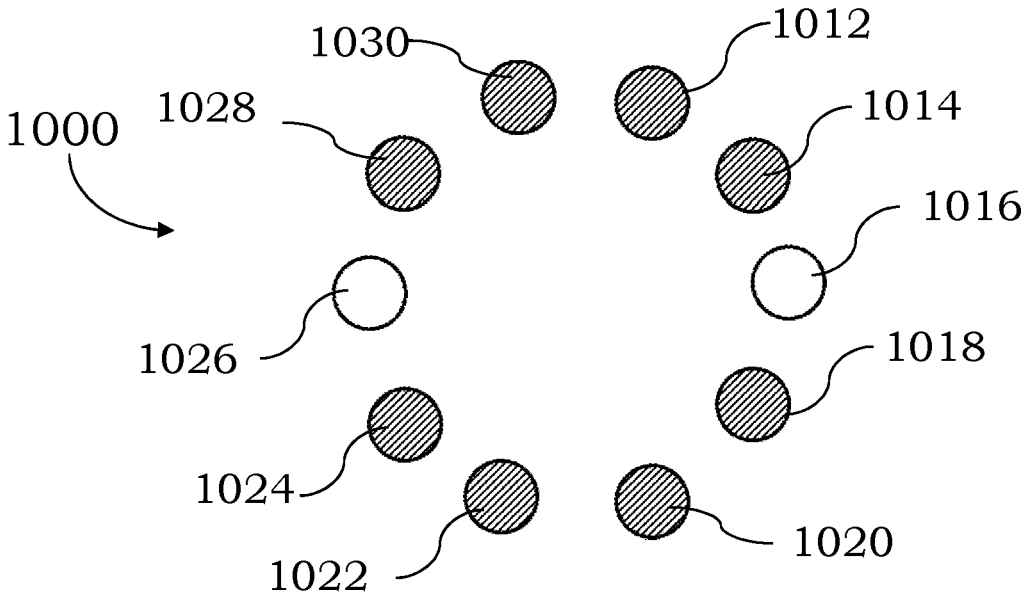
FIG. 10 is an illustration of a multipole rod assembly comprising ten rods where eight rods are used, in accordance with certain examples.

In certain embodiments where a rod assembly comprises ten rods, it may be desirable to use only eight of the rods to ionize analyte. Referring to FIG. 10, a rod assembly 1000 is shown comprising rods 1012, 1014, 1016, 1018, 1020, 1022, 1024, 1026, 1028 and 1030. As shown by the shading in FIG. 10, only rods 1012, 1014, 1018, 1020, 1022, 1024,

1028 and 1030 are active or used during ionization. Ten other rods could instead be used or active if desired. The two remaining rods may be switched on or activated at some period during ionization to change the fields within the rod assembly 1000. For example, a radio frequency field from only eight rods can be used during ionization for a first period, and then a radio frequency field from all ten rods 1012, 1014, 1016, 1018, 1020, 1022, 1024, 1026, 1028 and 1030 can be used for a second period or for different analytes. If desired, the RF field provided by two of the rods can be pulsed or switched on and off.

Figure 11:
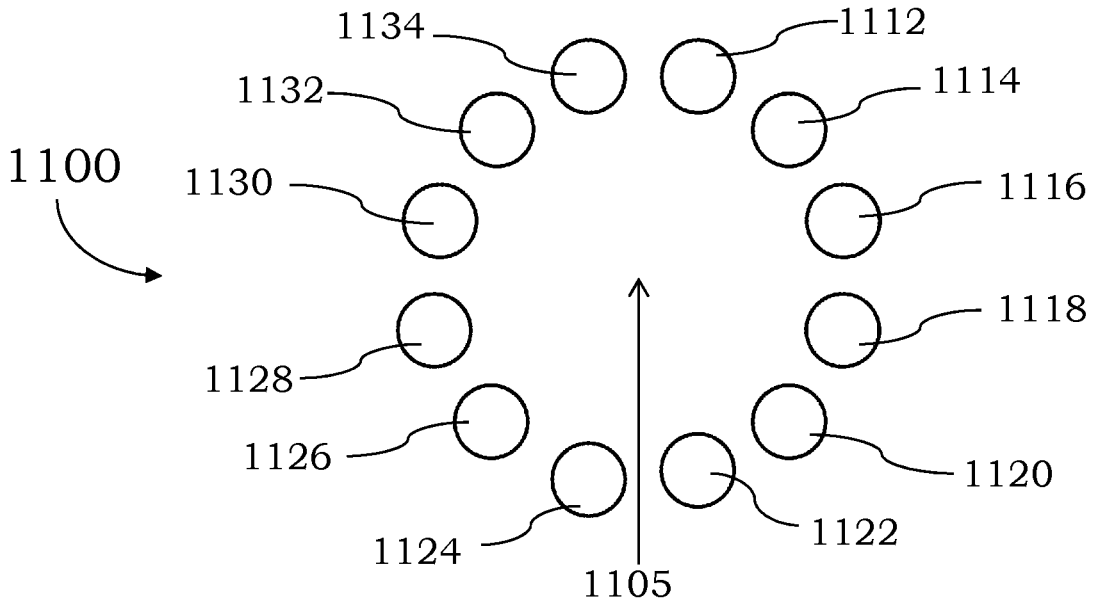
FIG. 11 is an illustration of a multipole rod assembly comprising twelve rods, in accordance with certain examples.

In certain embodiments, the ionization sources described herein may comprise twelve rods in a multipolar rod assembly 1100 as shown in the top view of FIG. 11. The rods 1112, 1114, 1116, 1118, 1120, 1122, 1124, 1126, 1128, 1130, 1132 and 1134 each may provide a magnetic field into an ion volume 1105 formed by the rod assembly 1100 and may also provide a radio frequency field into the ion volume 1105. For example, each of the rods 1112, 1114, 1116, 1118, 1120, 1122, 1124, 1126, 1128, 1130, 1132 and 1134 may be magnetic or magnetizable to provide the magnetic field within the ion volume 1105. In some configurations, each of the rods 1112, 1114, 1116, 1118, 1120, 1122, 1124, 1126, 1128, 1130, 1132 and 1134 may comprise a material which can be permanently magnetized or magnetized for at least some period. Each of the rods 1112, 1114, 1116, 1118, 1120, 1122, 1124, 1126, 1128, 1130, 1132 and 1134 may also be electrically coupled to a radio frequency generator so each rod provides a radio frequency field into the ion volume 1105. Each of the rods 1112, 1114, 1116, 1118, 1120, 1122, 1124, 1126, 1128, 1130, 1132 and 1134 may be electrically coupled to a common radio frequency generator or may be electrically coupled to a respective radio frequency generator. Alternatively, any two or more of the rods 1112, 1114, 1116, 1118, 1120, 1122, 1124, 1126, 1128, 1130, 1132 and 1134 can be electrically coupled to a radio frequency generator. The radio frequency field and the magnetic field each are provided by the rods 1112, 1114, 1116, 1118, 1120, 1122, 1124, 1126, 1128, 1130, 1132 and 1134. This arrangement can simplify the ionization sources described herein and permits, if desired, the omission of permanent magnets that are typically present external to an ionization chamber of existing ionization sources.

Figure 12:
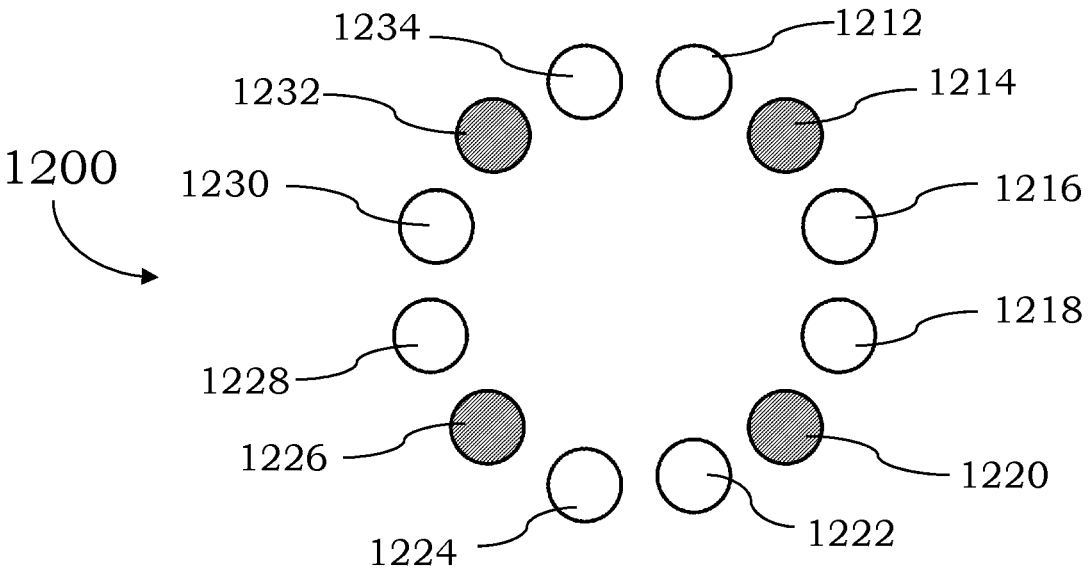
FIG. 12 is an illustration of a multipole rod assembly comprising twelve rods where four rods are used, in accordance with some examples.

In certain embodiments where a rod assembly comprises twelve rods, it may be desirable to use only four of the rods to ionize analyte. Referring to FIG. 12, a rod assembly 1200 is shown comprising rods 1212, 1214, 1216, 1218, 1220, 1222, 1224, 1226, 1228, 1230, 1232 and 1234. As shown by the shading in FIG. 12, only rods 1214, 1220, 1226 and 1232 are active or used during ionization. Four other rods could instead be active or used if desired. The eight remaining rods may be switched on or activated at some period during ionization to change the fields within the rod assembly 1200. For example, a radio frequency field from only four rods can be used during ionization for a first period, and then a radio frequency field from all twelve rods 1212, 1214, 1216, 1218, 1220, 1222, 1224, 1226, 1228, 1230, 1232 and 1234 can be used for a second period or for different analytes. If desired, the RF field provided by two, four, six or eight of the rods can be pulsed or switched on and off.

Figure 13:
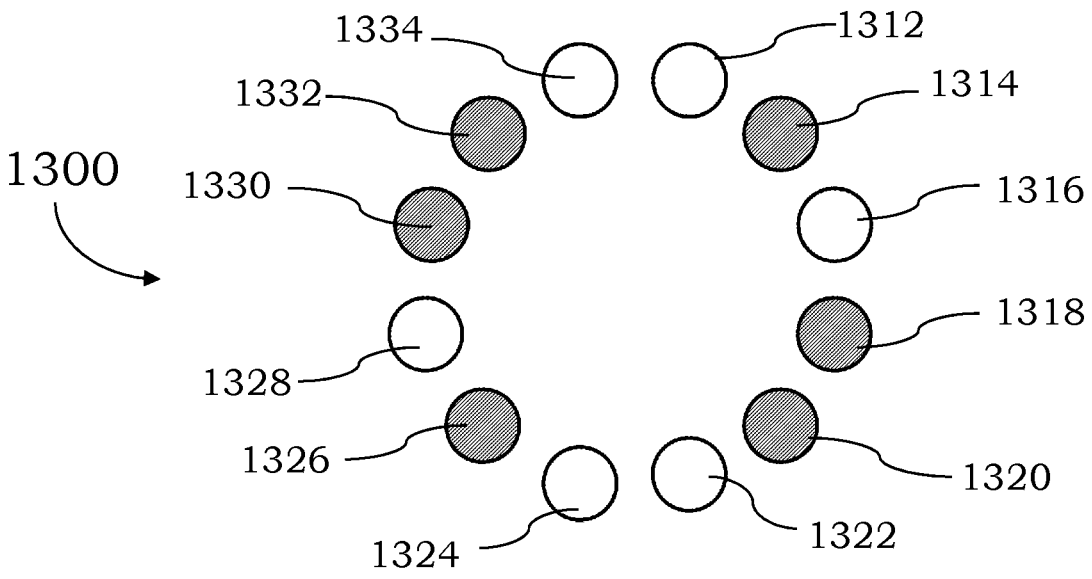
FIG. 13 is an illustration of a multipole rod assembly comprising twelve rods where six rods are used, in accordance with certain examples.

In certain examples where a rod assembly comprises twelve rods, it may be desirable to use only six of the rods to ionize analyte. Referring to FIG. 13, a rod assembly 1300 is shown comprising rods 1312, 1314, 1316, 1318, 1320, 1322, 1324, 1326, 1328, 1330, 1332 and 1334. As shown by the shading in FIG. 13, only rods 1314, 1318, 1320, 1326, 1330 and 1332 are active or used during ionization. Six other rods could instead be used or active if desired. The six remaining rods may be switched on or activated at some period during ionization to change the fields within the rod assembly 1300. For example, a radio frequency field from only six rods can be used during ionization for a first period, and then a radio frequency field from all twelve rods 1312, 1314, 1316, 1318, 1320, 1322, 1324, 1326, 1328, 1330, 1332 and 1334 can be used for a second period or for different analytes. If desired, the RF field provided by two, four or six of the rods can be pulsed or switched on and off.

Figure 14:
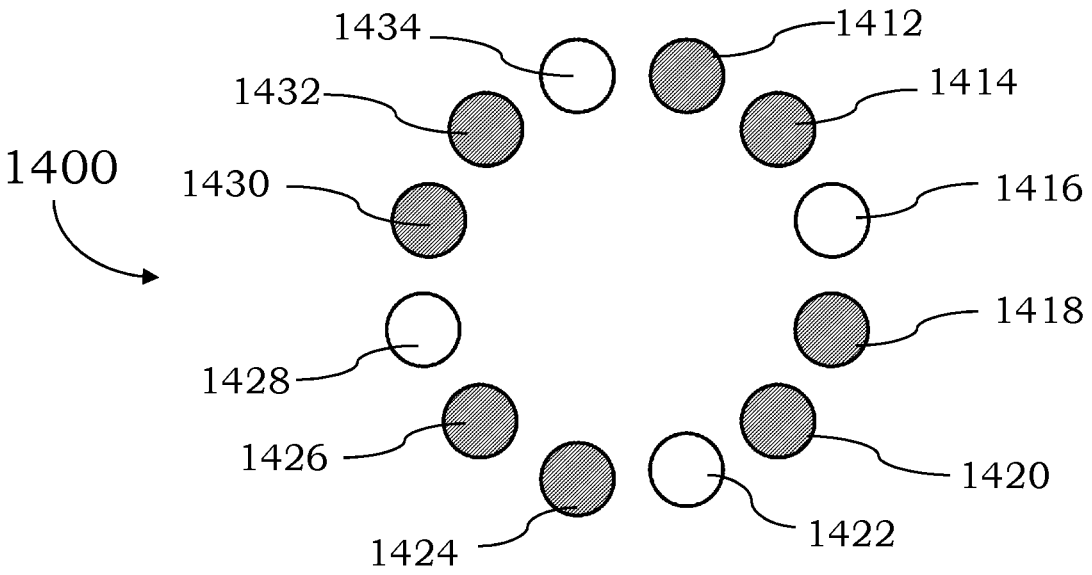
FIG. 14 is an illustration of a multipole rod assembly comprising twelve rods where eight rods are used, in accordance with some examples.

In other examples where a rod assembly comprises twelve rods, it may be desirable to use only eight of the rods to ionize analyte. Referring to FIG. 14, a rod assembly 1400 is shown comprising rods 1412, 1414, 1416, 1418, 1420, 1422, 1424, 1426, 1428, 1430, 1432 and 1434. As shown by the shading in FIG. 14, only rods 1412, 1414, 1418, 1420, 1424, 1426, 1430, and 1432 are active or used during ionization. Eight other rods could be active or used if desired. The four remaining rods may be switched on or activated at some period during ionization to change the fields within the rod assembly 1400. For example, a radio frequency field from only eight rods can be used during ionization for a first period, and then a radio frequency field from all twelve rods 1412, 1414, 1416, 1418, 1420, 1422, 1424, 1426, 1428, 1430, 1432 and 1434 can be used for a second period or for different analytes. If desired, the RF field provided by two or four of the rods can be pulsed or switched on and off.

Figure 15:
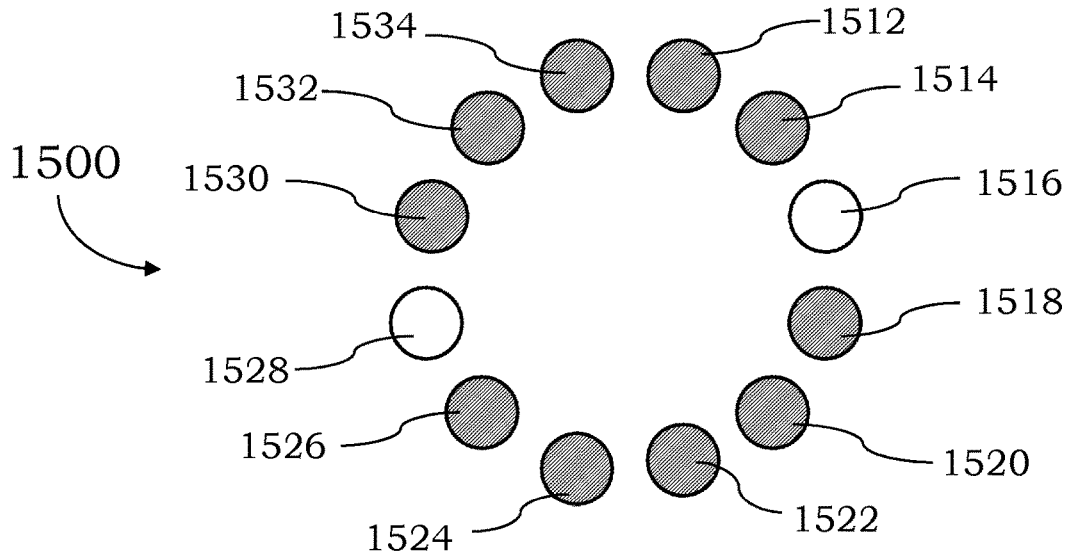
FIG. 15 is an illustration of a multipole rod assembly comprising twelve rods where ten rods are used, in accordance with certain examples.

In additional examples where a rod assembly comprises twelve rods, it may be desirable to use only ten of the rods to ionize analyte. Referring to FIG. 15, a rod assembly 1500 is shown comprising rods 1512, 1514, 1516, 1518, 1520, 1522, 1524, 1526, 1528, 1530, 1532 and 1534. As shown by the shading in FIG. 15, only rods 1512, 1514, 1518, 1520, 1522, 1524, 1526, 1530, 1532 and 1534 are active or used during ionization. Ten other rods could instead be active or used if desired. The two remaining rods may be switched on or activated at some period during ionization to change the fields within the rod assembly 1500. For example, a radio frequency field from only ten rods can be used during ionization for a first period, and then a radio frequency field from all twelve rods 1512, 1514, 1516, 1518, 1520, 1522, 1524, 1526, 1528, 1530, 1532 and 1534 can be used for a second period or for different analytes. If desired, the RF field provided by two of the rods can be pulsed or switched on and off.

Figure 16:
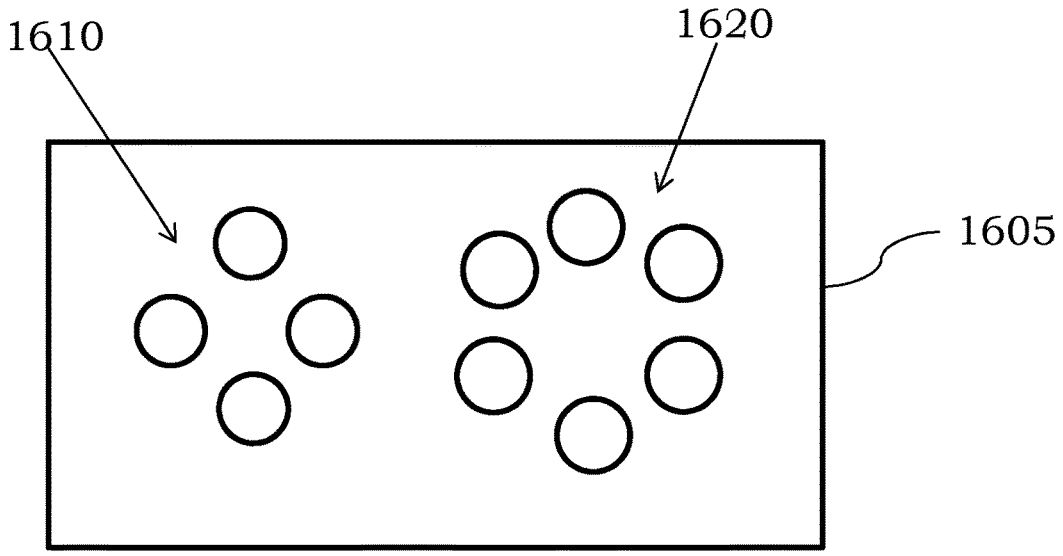
FIG. 16 is an illustration of a multipole rod assembly comprising two separate rod assemblies, in accordance with certain examples.

Even though multipolar rod assemblies comprising two, four, six, eight, ten and twelve individual rods are described, more than twelve individual rods can be present in the an ionization source. Further, an ionization source may comprise more than a single multipolar rod assembly present in any one ionization source. The number of rods present in the different rod assemblies can be the same or can be different. An illustration is shown in FIG. 16 where a first multipolar rod assembly 1610 comprising four rods is present in combination with a second multipolar rod assembly 1620 comprising six rods. Each respective rod assembly may comprise its own electron source or a common electron source can be used to provide electrons to each of the assemblies 1610, 1620. The assemblies 1610, 1620 are shown as being present in a housing or enclosure 1605, though this housing can be omitted if desired.

In certain embodiments, the multipolar rod assemblies described herein can be used with an electron source. The electron source generally provides free electrons into a space formed by assembly of the rods. One factor controlling the detection limit ("sensitivity") of a mass spectrometer is the efficiency of conversion of molecules to ions in the ion source (proportion of molecule ionized). One way that can improve detection limits is to provide a "brighter" ion source. The magnetic and RF fields from the rod assemblies described herein can be used to confine, guide, constrain of focus the electrons, which can then be used to ionize analyte molecules introduced into the space occupied by the electrons. This coaxial ionization of sample molecules can result in a larger interaction volume of the electrons and molecules than the conventional "Nier"-type ion source where the electron beam is perpendicular to the ion beam and can provide a proportionately higher ionization efficiency. Appropriate selection of voltages for repeller and lens elements before and after the ion volume can permit reflection of electrons back and forth through the ion volume, increasing the effective electron source brightness and ionization efficiency even more. The resulting ion products can exit the rod assembly and be provided to a downstream component such as, for example, an ion guide, a mass analyzer, a detector, etc. In some embodiments, the electron source can be configured as wire, coil, ribbon, field emitter, filament or combinations thereof.

In some examples, the materials used in the rods of the rod assemblies described herein can be magnetic, magnetizable or magnetized. For example, it may be desirable to assemble the rod assembly and then magnetize the various rods. If desired, however, the rods can be magnetized individually and then assembled into a multipolar rod assembly. In some examples, once magnetized the rods can remain magnetic for the life of the rod assembly. In other instances, periodic re-magnetization of the rods may be performed. For example, during cleaning of the rods, the rods can be re-magnetized. Illustrative materials that can be used in the rods include, but are not limited to, iron alloys including one or more of nickel, cobalt, aluminum or other materials. In some instances, the material used in the rod may be an aluminum alloy that comprises aluminum, nickel, cobalt, copper, titanium and optionally other materials. For example, alnico materials can be used in the rod described herein. If desired, rare earth materials could instead be used in the rod assemblies described herein. For example, the rod assemblies described herein may comprise rare earth metals including, but not limited to, yttrium, samarium, neodymium and optionally may comprise other elements including, for example, boron, iron, cobalt, copper, zirconium or other metals and non-metals. The exact field strength provided by the rods can vary and need not be the same for each rod. While the exact remanence provided can vary with temperature, illustrative field strengths after the rods are magnetized include, but are not limited to, 0.005 Tesla to about 1.5 Tesla, more particularly about 0.6 Tesla to about 1.2 Tesla or about 0.8 Tesla to about 1 Tesla. While temperatures can vary depending on the particular device or system where the ionization source is present, the rod assemblies are typically used at working temperatures up to 350 degrees Celsius, though higher temperatures may also be used.

In certain embodiments, the rod assemblies can be assembled prior to magnetization and then the combined rods can be magnetized using an external magnetic field which can be provided from many different types of magnets. Alternatively, each rod can be magnetized and then added to the rod assembly. The rod assembly can be periodically exposed to an external magnetic field to re-magnetize the rod assembly if magnetization is lost over time. Alternatively, the field strength could be changed by exposing the rod assembly to a different external magnetic field.

Figure 17:
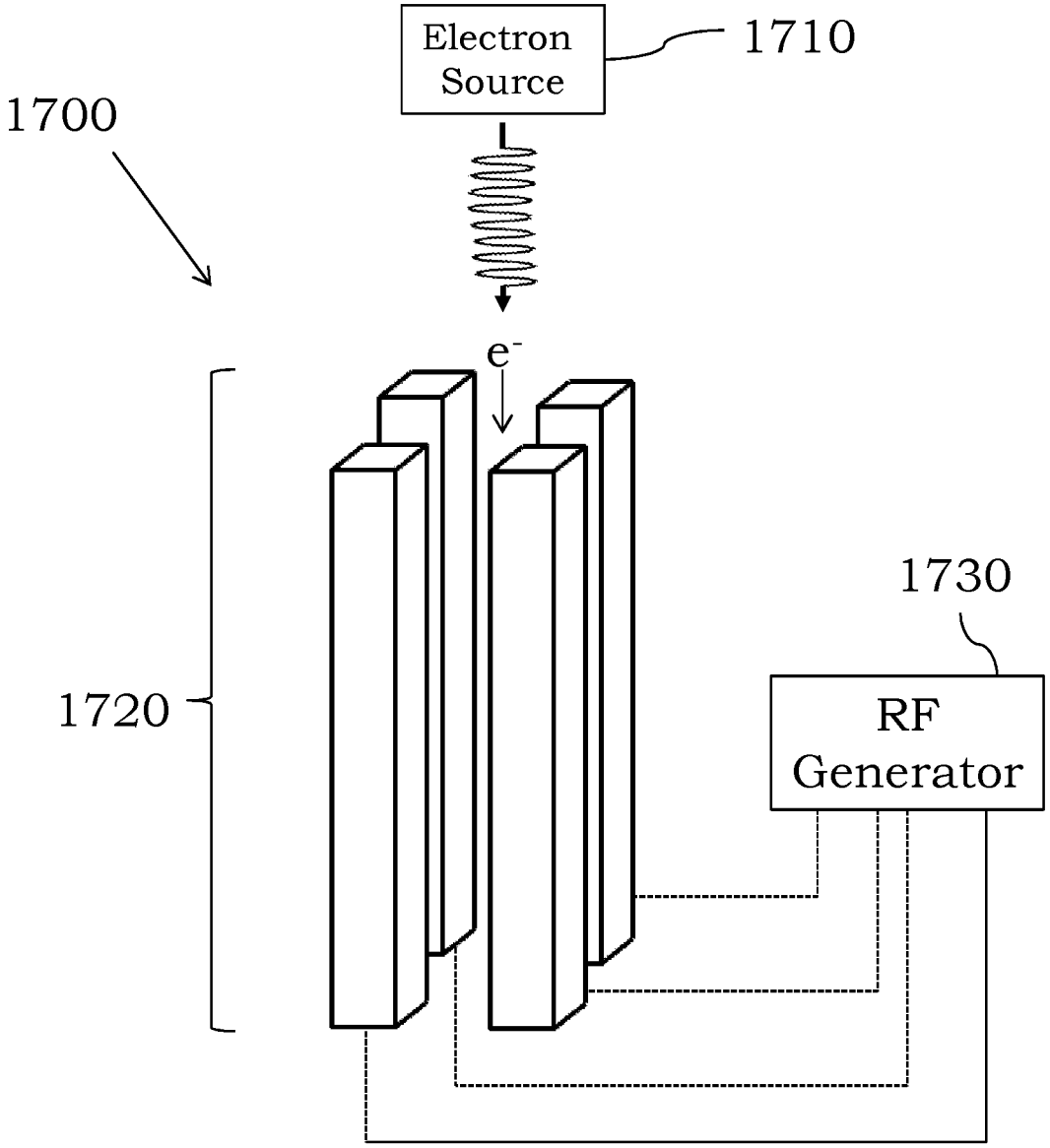
FIG. 17 is an illustration of an ionization source comprising an electron source and a rod assembly, in accordance with some embodiments.

In certain embodiments, the ionization sources described herein may comprise an electron source that can provide electrons to a space or ion volume formed by arrangement of the rods. Referring to FIG. 17, an ionization source 1700 is shown that comprises an electron source 1710 and a multipolar rod assembly 1720, which in this instance is configured as four square rods. While four rods are show in the assembly 1720, six, eight, ten, twelve or more rods could instead be present and the rod-shape need not be square. The electron source 1710 is fluidically coupled to an inner space or ion volume formed by the rod assembly 1720 so electrons provided from the electron source 1710 can enter into the ion volume and ionize analyte species introduced into ion volume. For example, analyte can be introduced through an open space at the top of the rod assembly 1720, or through the side between rods, and confined within the rod assembly 1720. The direction of electron entry is generally parallel to a longitudinal axis of the rods of the assembly 1720. A radio frequency generator 1730 can be electrically coupled to each of the rods of the rod assembly 1720 to provide individual radio frequency voltages to each rod, or several rods may be provided the same voltage. As noted herein, each of the rods of the rod assembly is also typically magnetized or magnetizable so a magnetic field is present within the ion volume. The ionization source 1700 need not have an enclosure or ionization block but may have one as noted below.

Figure 18:
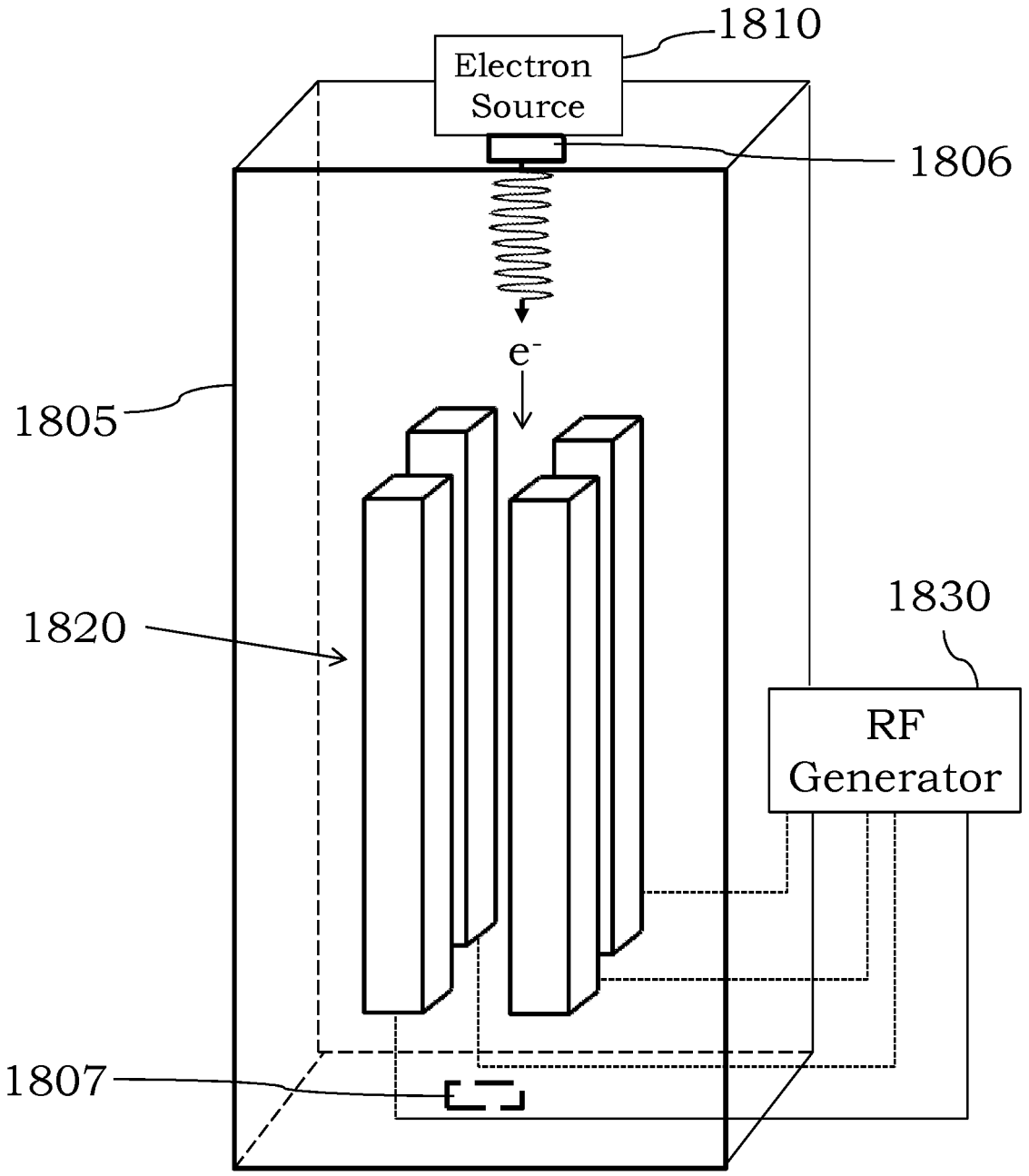
FIG. 18 is an illustration of an ionization source comprising an enclosure or ionization block, in accordance with certain examples.

In some embodiments, the rod assembly can be positioned within an enclosure or ionization block which itself can be charged or magnetized as desired. Referring to FIG. 18, an enclosure or ionization block 1805 is shown that comprises an entrance aperture 1806 and an exit aperture 1807. A rod assembly 1820 is shown within the ionization block 1805. The entrance aperture 1806 permits introduction of electrons from an electron source 1810 and optionally a sample in a direction that is generally parallel with a longitudinal axis of the ionization block 1805 and is fluidically coupled to the ion volume, e.g., the space within the rod assembly 1810, such that electrons from an electron source 1805 (and optionally analyte sample) are introduced longitudinally into the rod assembly 1820. If desired, a separate sample aperture or port (not shown) can be used to introduce analyte sample into the rod assembly 1820. In some embodiments, no external permanent magnets may be used with the ionization block 1805, since the rod assembly 1820 can provide each of a magnetic field and a RF field. For example, a RF generator 1830 can be electrically coupled to each of the rods of the rod assembly 1820, and each rod may also be magnetic or magnetizable.

In another embodiment, an element with low electrical but high RF conductivity, such as a glass or fused silica tube, can be inserted through the rod assembly to act as the ion volume, both isolating the analytes from the rods, preventing rod contamination or analyte decomposition, and contain the analytes at a higher pressure than if they diffused between the rods, thereby increasing the molecular concentration and electron-molecule collision probability.

In another embodiment (see FIG. 23G) the spacing between the rods can be designed to control the pressure of the analytes in the center of the rod assembly by controlling their diffusion rate to the outside.

Figure 19:
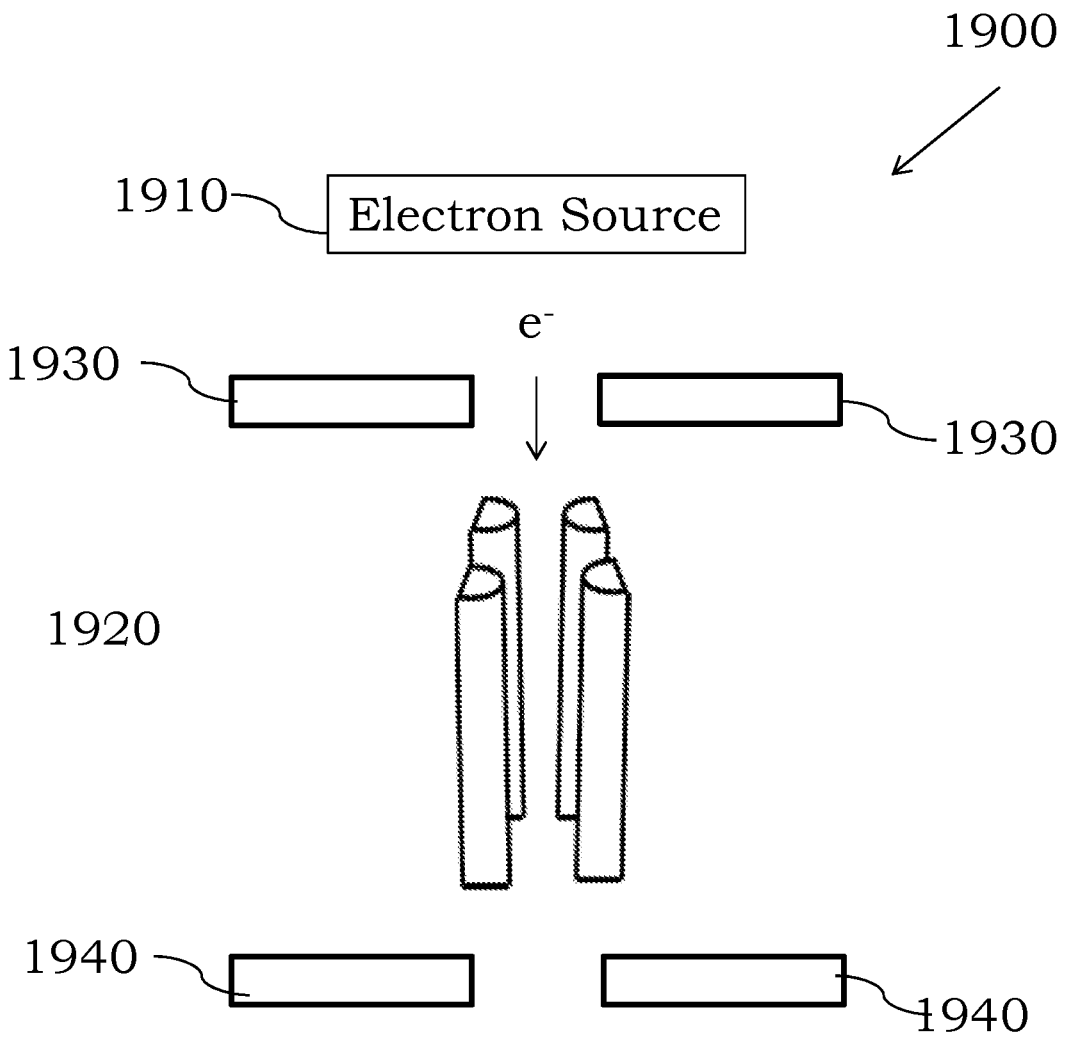
FIG. 19 is another illustration of an ionization source comprising an ion repeller and an electron reflector, in accordance with some embodiments.

In some embodiments, the ionization sources described herein may comprise a rod assembly, an electron source, an electron or ion repeller and an exit lens or reflector. One simplified illustration an assembly is shown in FIG. 19. A rod assembly using six, eight, ten, twelve or more rods could instead be used if desired. The ionization source 1900 comprises a rod assembly 1920 comprising four rods, an electron source 1910 that can provide electrons into the ion volume formed by the rod assembly 1920, an electron or ion repeller 1930 and a lens or reflector 1940. While not shown, the rods 1910 can extend past the electron source 1910 with the electron source 1910. The repeller 1930 can force electrons away from the electron source 1910 as they are emitted. The electron lens 1940 can attract electrons or ions within the ion volume toward the electron lens 1940. Alternatively, a suitable voltage can be applied to the lens/reflector 1940 to reflect the electrons back into the ion volume and provide an electron trap. While not shown, lenses, guides or other components may be present adjacent to or near the lens/reflector 1940 to promote extraction of ions from the ion volume and transport out of the ionization source 1900 so they may be provided to a downstream component.

Figure 20:
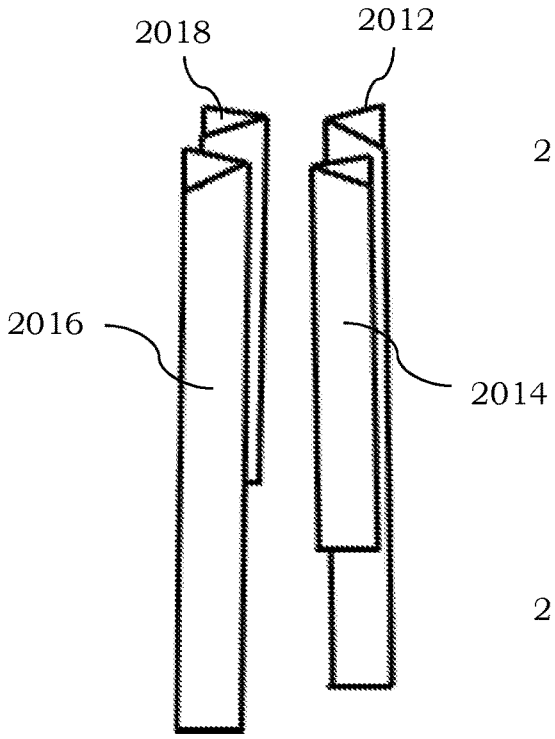
FIG. 20 is an illustration of a rod assembly with at least one rod of varying length, in accordance with some embodiments.
Figure 21:
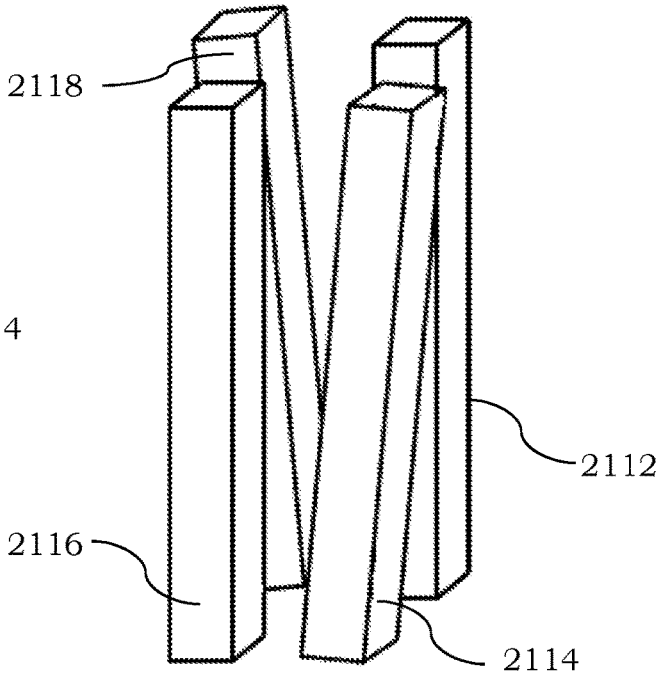
FIG. 21 is an illustration of a rod assembly with at least one tilted rod, in accordance with certain examples.
Figure 22A:
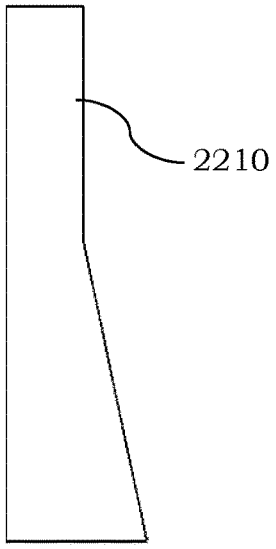
FIGS. 22A and 22B are illustrations of rods that comprise a different width at different areas of the rods, in accordance with some examples.
Figure 22B:
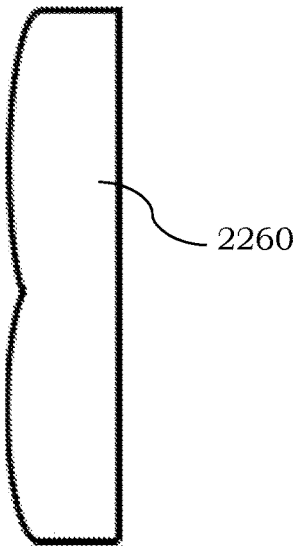

In certain embodiments, the rods of the multipolar rod assembly need not have the same length, shape or dimensions. Referring to FIG. 20, an illustration is shown where rods 2012 and 2016 comprise a different length than rods 2014 and 2018. Further, the rods need not be parallel to each other. One or more of the rods can be tilted as shown in FIG. 21, where rods 2114 and 2118 are shown as being tilted slightly compared to rods 2112 and 2116. Without wishing to be bound by any one configuration, tilting of one or more rods can provide a focusing effect for the electrons and/or any ions and may permit an increased amount of ions to be present in a central area of an ion beam that exits the ionization source. In certain embodiments, a cross-sectional width of at least one rod of the multipolar rod assembly can vary along a length of the at least one rod. Referring to FIG. 22A, an illustration is shown where a rod 2210 comprises a larger width toward an exit end of the rod than toward and entrance end. Another illustration is shown in FIG. 22B where a rod 2260 comprises a variable width along its length.

Figure 23A:
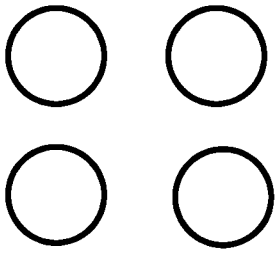
FIGS. 23A, 23B, 23C, 23D, 23E, 23F and 23G show various cross-sectional shapes for rods, in accordance with certain embodiments.
Figure 23B:
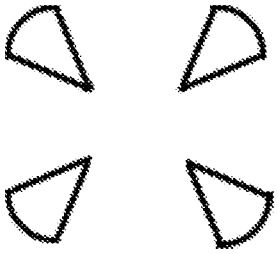
Figure 23C:
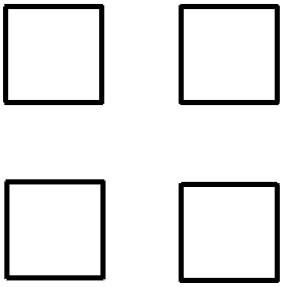
Figure 23D:
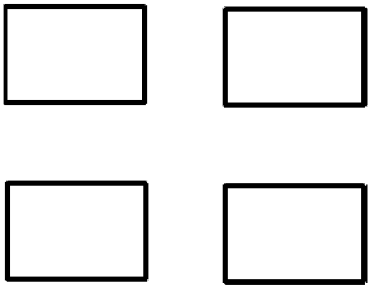
Figure 23E:
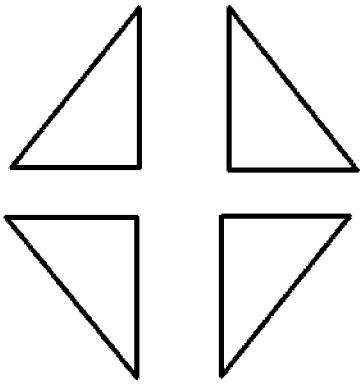
Figure 23F:
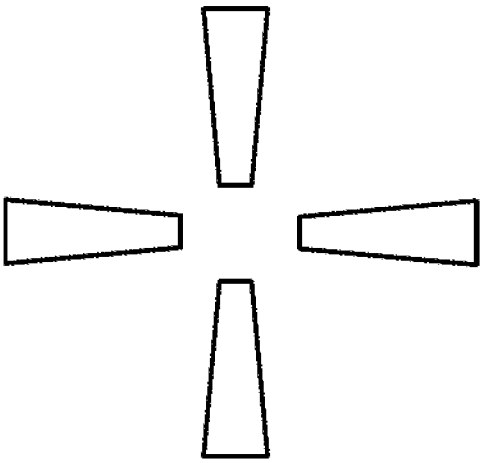
Figure 23G:
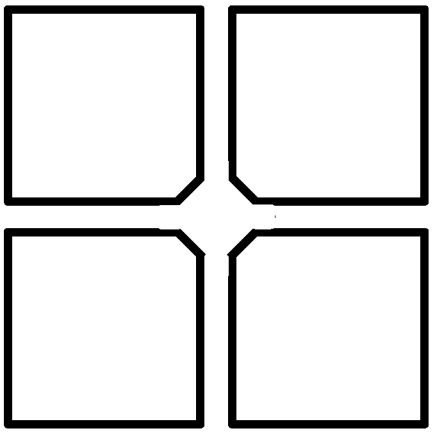
Figure 24:
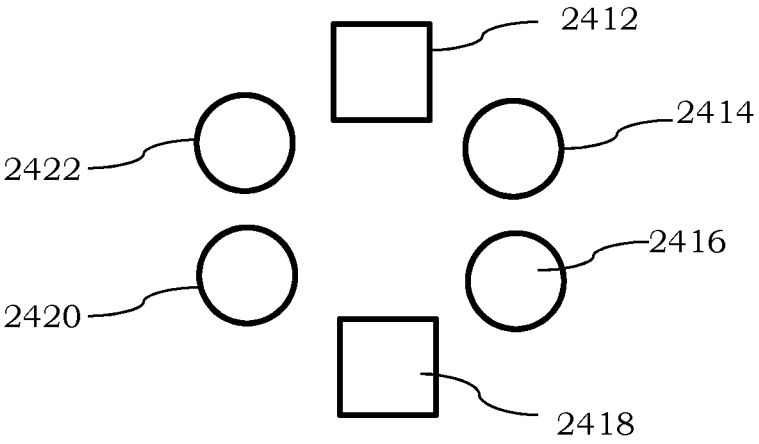
FIG. 24 shows a rod assembly where at least one rod has a different cross-sectional shape, in accordance with some examples.

In some examples, the cross-sectional shape of the rods can be the same or can be different as desired. Numerous different kinds of shapes for the rods can be sued, and the rods of any one rod assembly need not have the same shape. FIGS. 23A-23G show top views of rod assemblies with four rods to illustrate some of these shapes. Illustrative shapes include, but are not limited to, round (FIG. 23A), tapered (FIG. 23B), square (FIG. 23C), rectangular (FIG. 23D), triangular (FIG. 23E), trapezoidal (FIG. 23F), parabolic, hyperbolic, conical or other geometric shapes. As shown in FIG. 23G, an inner shape of the rods can be different than an outer shape of the rods. As noted herein, the rods need not have the same shape. Referring to FIG. 24, a six rod assembly is shown where rods 2412 and 2418 comprise a different cross-sectional shape than rods 2414, 2416, 2420 and 2422.

In certain examples, the ionization sources described herein can be used in a system comprising one or more other components. For example, the ionization sources may be fluidically coupled to an upstream component that can provide an analyte to an inlet or entrance aperture of the ionization source and/or can be fluidically coupled to a downstream component to provide ions to the downstream component for analysis or further use.

Figure 25:
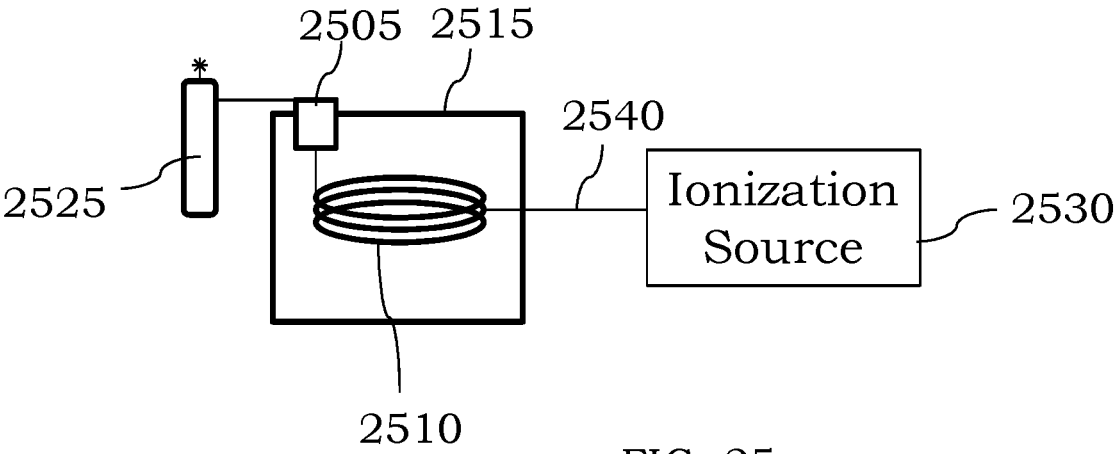
FIG. 25 is an illustration of a gas chromatography system coupled to an ionization source, in accordance with some examples.

Referring to FIG. 25, an ionization source 2530 is shown as being fluidically coupled to a gas chromatography system. The gas chromatography system comprises an injector 2505 fluidically coupled to a column 2510 positioned in an oven 2515. The injector 2505 and/or column 2510 are also fluidically coupled to a mobile phase 2525, i.e. a gas, which can be used with a stationary phase of the column 2510 to separate two or more analytes in an introduced sample. As individual analytes elute from the column 2510, they can be provided to an inlet of the ionization source 2530 for ionization. While the column 2510 is shown as being directly coupled to an inlet of the ionization source 2530, one or more transfer lines, interfaces, etc. could instead be used. For example, a transfer line 2540 can be used to fluidically couple the column 2510 to an inlet of the ionization source 2530. The transfer line 2540 may be heated (if desired or needed) to maintain the analytes in the gas phase. Additional components may also be present between the column 2510 and the ionization source, 2530, e.g., interfaces, splitters, an optical detection cell, concentration chambers, filters and the like.

Figure 26:
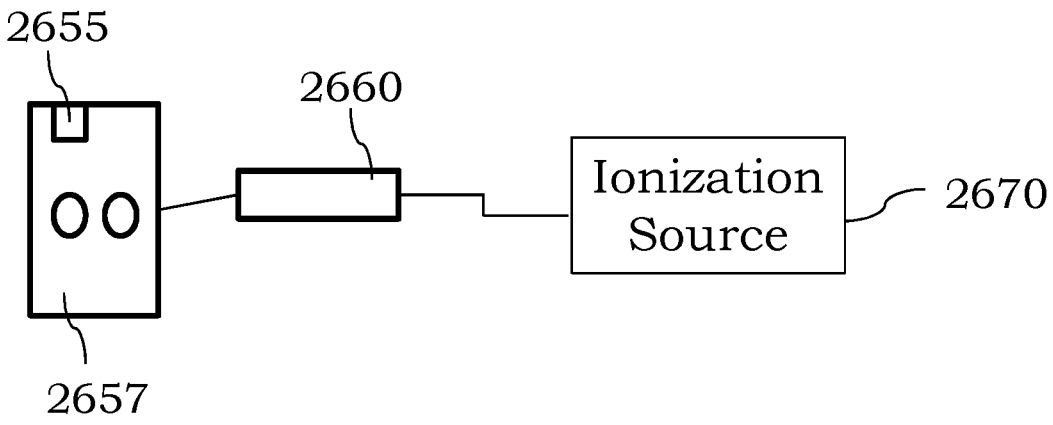
FIG. 26 is an illustration of a liquid chromatography system coupled to an ionization source, in accordance with some examples.

In some embodiments, an ionization source as described herein can be fluidically coupled to a liquid chromatography (LC) system. Referring to FIG. 26, a LC system comprises an injector 2655 fluidically coupled to a column 2660 through one or more pumps 2657. The injector 2655 and/or column 2660 are also fluidically coupled to a mobile phase, i.e. a liquid, and the one or more pumps 2657 which can be used to pressurize the LC system. The column 2660 typically comprises a stationary phase selected to separate two or more analytes in an introduced sample. As individual analytes elute from the column 2660, they can be provided to an inlet of an ionization source 2670 for ionization. While the column 2660 is shown as being directly coupled to an inlet of the ionization source 2670, one or more transfer lines, interfaces, etc. could instead be used. For example, a flow splitter can be used if desired. Additional components may also be present between the column 2660 and the ionization source 2670, e.g., interfaces, splitters, an optical detection cell, concentration chambers, filters and the like.

Figure 27:
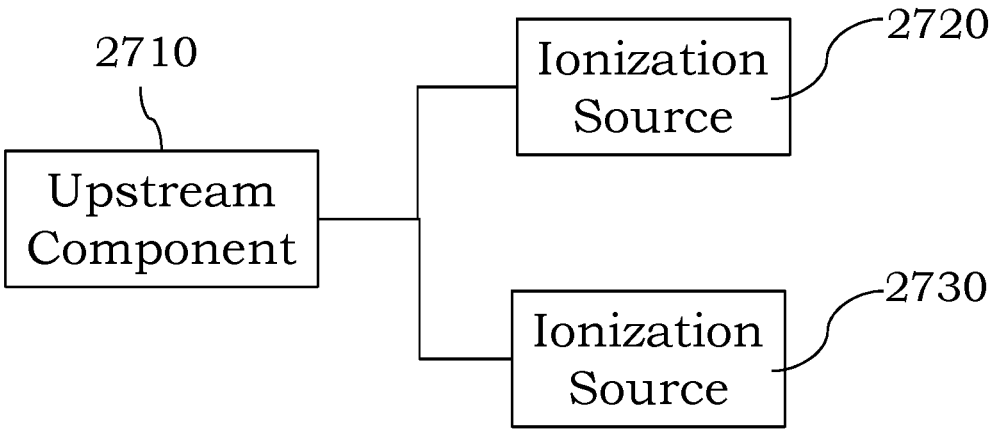
FIG. 27 is an illustration of an upstream component coupled to two ionization sources, in accordance with certain examples.

In some embodiments, a chromatography system or other upstream component can be fluidically coupled to two or more ionization sources. Referring to FIG. 27, an illustration is shown where an upstream component 2710 can be fluidically coupled to each of an ionization source 2720 and an ionization source 2730, which can be the same or can be different. For example, one of the ionization sources may comprise a rod assembly as described herein, and the other ionization source may comprise one or more of the ionization sources as noted below in connection with mass spectrometers. Alternatively, the ionization sources 2720, 2730 each can be configured with one or more rods as described herein but may comprise a different number of rods, rods with different shapes or the same rods with the same shapes but where the rods are operated using different RF voltages.

Figure 28:
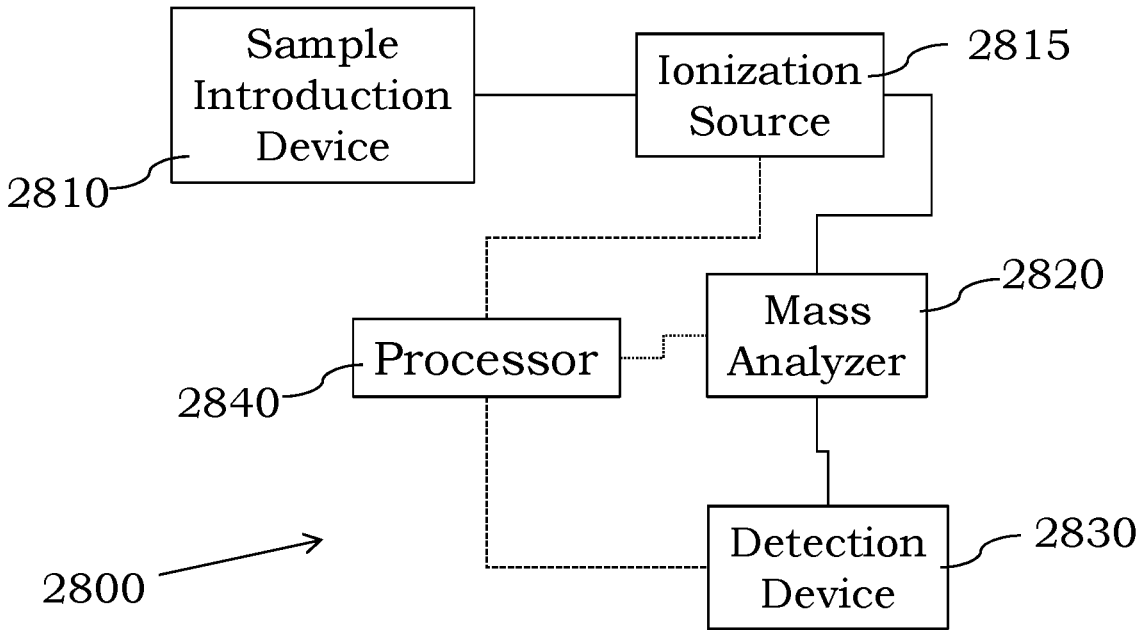
FIG. 28 is an illustration of certain components of a mass spectrometer, in accordance with some embodiments.

In some examples, the ionization source can be present in a mass spectrometer. For example, the ionization sources disclosed herein may also be used in or with a mass analyzer. In particular, the mass spectrometer may include one or more ionization sources chambers directly coupled to an inlet of a mass analyzer or spatially separated from an inlet of a mass analyzer. An illustrative MS device is shown in FIG. 28. A MS device 2800 includes a sample introduction device 2810, an ionization source 2815, a mass analyzer 2820, a detection device 2830, a processor 2840 and an optional display (not shown). The mass analyzer 2820 and the detection device 2830 may be operated at reduced pressures using one or more vacuum pumps and/or vacuum pumping stages as noted in more detail below. The sample introduction device 2810 may be a GC system, an LC system, a nebulizer, aerosolizer, spray nozzle or head or other devices which can provide a gas or liquid sample to the ionization source 2815. Where solid samples are used the sample introduction device 2810 may comprise a direct sample analysis (DSA) device or other devices which can introduce analyte species from solid samples. The discharge chamber 2815 may be any of those described herein or other suitable discharge chambers. The mass analyzer 2820 can take numerous forms depending generally on the sample nature, desired resolution, etc. and exemplary mass analyzers are discussed further below. The detection device 2830 can be any suitable detection device that can be used with existing mass spectrometers, e.g., electron multipliers, Faraday cups, coated photographic plates, scintillation detectors, etc. and other suitable devices that will be selected by the person of ordinary skill in the art, given the benefit of this disclosure. The processor 2840 typically includes a microprocessor and/or computer and suitable software for analysis of samples introduced into the MS device 2800. If desired, one or more databases can be accessed by the processor 2840 for determination of the chemical identity of species introduced into the MS device 2800. Other suitable additional devices known in the art can also be used with the MS device 2800 including, but not limited to, autosamplers, such as the Clarus GC autosampler commercially available from PerkinElmer Health Sciences, Inc.

In certain embodiments, the mass analyzer 2820 of MS device 2800 can take numerous forms depending on the desired resolution and the nature of the introduced sample. In certain examples, the mass analyzer is a scanning mass analyzer, a magnetic sector analyzer (e.g., for use in single and double-focusing MS devices), a quadrupole mass analyzer, an ion trap analyzer (e.g., cyclotrons, quadrupole ions traps), time-of-flight analyzers, and other suitable mass analyzers that can separate species with different mass-to-charge ratios. As noted in more detail below, the mass analyzer may comprise two or more different devices arranged in series, e.g., tandem MS/MS devices or triple quadrupole devices, to select and/or identify the ions that are received from the ionization source 2815.

In certain other examples, the ionization sources disclosed herein may be used with existing ionization methods used in mass spectroscopy. For example, a MS instrument with a dual source where one of the sources comprises an ionization source as described herein and the other source is a different ionization source can be assembled. The different ionization source may be, for example, an electron ionization source, a chemical ionization source, a field ionization source, desorption sources such as, for example, those sources configured for fast atom bombardment, field desorption, laser desorption, plasma desorption, thermal desorption, electrohydrodynamic ionization/desorption, etc., thermospray or electrospray ionization sources or other types of ionization sources. By including two different ionization sources in a single instrument, a user can select which particular ionization methods may be used.

In accordance with certain other examples, an MS system comprising an ionization source as disclosed herein can be hyphenated with one or more other analytical techniques. For example, a MS system can be hyphenated one or more devices for performing thermogravimetric analysis, liquid chromatography, gas chromatography, capillary electrophoresis, and other suitable separation techniques. When coupling an MS device to a gas chromatograph, it may be desirable to include a suitable interface, e.g., traps, jet separators, etc., to introduce sample into the MS device from the gas chromatograph. When coupling an MS device to a liquid chromatograph, it may also be desirable to include a suitable interface to account for the differences in volume used in liquid chromatography and mass spectroscopy. For example, split interfaces can be used so that only a small amount of sample exiting the liquid chromatograph is introduced into the MS device. Sample exiting from the liquid chromatograph may also be deposited in suitable wires, cups or chambers for transport to the discharge chamber of the MS device. In certain examples, the liquid chromatograph may include an electrospray configured to vaporize and aerosolize sample as it passes through a heated capillary tube. Other suitable devices for introducing liquid samples from a liquid chromatograph into a MS device, or other devices, will be readily selected by the person of ordinary skill in the art, given the benefit of this disclosure.

In certain examples, an MS device that includes an ionization source as described herein may be hyphenated to at least one other MS device, which may or may not include its own ionization source as described herein or other suitable ionization sources, for tandem mass spectroscopy analyses. For example, one MS device can include a first type of mass analyzer and the second MS device can include a different or similar mass analyzer than the first MS device. In other examples, the first MS device may be operative to isolate specific ions, and the second MS device may be operative to fragment/detect the isolated ions. It will be within the ability of the person of ordinary skill in the art, given the benefit of this disclosure, to design hyphenated MS/MS devices at least one of which includes an ionization source as described herein. In some examples, the mass analyzer of the MS device may comprise two or more quadrupoles which can be configured the same or different. For example, a double or triple quadrupole assembly may be used to select ions from an ion beam exiting the ionization source.

In certain examples, the methods and systems herein may comprise or use a processor, which can be part of the system or instrument or present in an associated device, e.g., computer, laptop, mobile device, etc. used with the instrument. For example, the processor can be used to control the radio frequency voltages and/or frequencies provided to the rods of the multipolar rod assembly in the ionization sources and can control the mass analyzer and/or can be used by the detector. Such processes may be performed automatically by the processor without the need for user intervention or a user may enter parameters through user interface. For example, the processor can use signal intensities and fragment peaks along with one or more calibration curves to determine an identity and how much of each molecule is present in a sample. In certain configurations, the processor may be present in one or more computer systems and/or common hardware circuitry including, for example, a microprocessor and/or suitable software for operating the system, e.g., to control the sample introduction device, ionization sources, mass analyzer, detector, etc. In some examples, the detection device itself may comprise its own respective processor, operating system and other features to permit detection of various molecules. The processor can be integral to the systems or may be present on one or more accessory boards, printed circuit boards or computers electrically coupled to the components of the system. The processor is typically electrically coupled to one or more memory units to receive data from the other components of the system and permit adjustment of the various system parameters as needed or desired. The processor may be part of a general-purpose computer such as those based on Unix, Intel PENTIUM-type processor, Intel Core™ processors, Intel Xeon™ processsors, AMD Ryzen™ processors, AMD Athlon™ processors, AMD FX™ processors, Motorola PowerPC, Sun UltraSPARC, Hewlett-Packard PA-RISC processors, Apple-designed processors including Apple A12 processor, Apple A11 processor and others or any other type of processor. One or more of any type computer system may be used according to various embodiments of the technology. Further, the system may be connected to a single computer or may be distributed among a plurality of computers attached by a communications network. It should be appreciated that other functions, including network communication, can be performed and the technology is not limited to having any particular function or set of functions. Various aspects may be implemented as specialized software executing in a general-purpose computer system. The computer system may include a processor connected to one or more memory devices, such as a disk drive, memory, or other device for storing data. Memory is typically used for storing programs, calibration curves, radio frequency voltage values and data values during operation of the ionization sources and any instrument including the ionization sources described herein. Components of the computer system may be coupled by an interconnection device, which may include one or more buses (e.g., between components that are integrated within a same machine) and/or a network (e.g., between components that reside on separate discrete machines). The interconnection device provides for communications (e.g., signals, data, instructions) to be exchanged between components of the system. The computer system typically can receive and/or issue commands within a processing time, e.g., a few milliseconds, a few microseconds or less, to permit rapid control of the system. For example, computer control can be implemented to control sample introduction, rod RF voltages and/or frequencies provided to each rod, detector parameters, etc. The processor typically is electrically coupled to a power source which can, for example, be a direct current source, an alternating current source, a battery, a fuel cell or other power sources or combinations of power sources. The power source can be shared by the other components of the system. The system may also include one or more input devices, for example, a keyboard, mouse, trackball, microphone, touch screen, manual switch (e.g., override switch) and one or more output devices, for example, a printing device, display screen, speaker. In addition, the system may contain one or more communication interfaces that connect the computer system to a communication network (in addition or as an alternative to the interconnection device). The system may also include suitable circuitry to convert signals received from the various electrical devices present in the systems. Such circuitry can be present on a printed circuit board or may be present on a separate board or device that is electrically coupled to the printed circuit board through a suitable interface, e.g., a serial ATA interface, ISA interface, PCI interface, a USB interface, a Fibre Channel interface, a Firewire interface, a M.2 connector interface, a PCIE interface, a mSATA interface or the like or through one or more wireless interfaces, e.g., Bluetooth, Wi-Fi, Near Field Communication or other wireless protocols and/or interfaces.

In certain embodiments, the storage system used in the systems described herein typically includes a computer readable and writeable nonvolatile recording medium in which codes of software can be stored that can be used by a program to be executed by the processor or information stored on or in the medium to be processed by the program. The medium may, for example, be a hard disk, solid state drive or flash memory. The program or instructions to be executed by the processor may be located locally or remotely and can be retrieved by the processor by way of an interconnection mechanism, a communication network or other means as desired. Typically, in operation, the processor causes data to be read from the nonvolatile recording medium into another memory that allows for faster access to the information by the processor than does the medium. This memory is typically a volatile, random access memory such as a dynamic random access memory (DRAM) or static memory (SRAM). It may be located in the storage system or in the memory system. The processor generally manipulates the data within the integrated circuit memory and then copies the data to the medium after processing is completed. A variety of mechanisms are known for managing data movement between the medium and the integrated circuit memory element and the technology is not limited thereto. The technology is also not limited to a particular memory system or storage system. In certain embodiments, the system may also include specially-programmed, special-purpose hardware, for example, an application-specific integrated circuit (ASIC), microprocessor units MPU) or a field programmable gate array (FPGA) or combinations thereof. Aspects of the technology may be implemented in software, hardware or firmware, or any combination thereof. Further, such methods, acts, systems, system elements and components thereof may be implemented as part of the systems described above or as an independent component. Although specific systems are described by way of example as one type of system upon which various aspects of the technology may be practiced, it should be appreciated that aspects are not limited to being implemented on the described system. Various aspects may be practiced on one or more systems having a different architecture or components. The system may comprise a general-purpose computer system that is programmable using a high-level computer programming language. The systems may be also implemented using specially programmed, special purpose hardware. In the systems, the processor is typically a commercially available processor such as the well-known microprocessors available from Intel, AMD, Apple and others. Many other processors are also commercially available. Such a processor usually executes an operating system which may be, for example, the Windows 7, Windows 8 or Windows 10 operating systems available from the Microsoft Corporation, MAC OS X, e.g., Snow Leopard, Lion, Mountain Lion, Mojave, High Sierra, El Capitan or other versions available from Apple, the Solaris operating system available from Sun Microsystems, or UNIX or Linux operating systems available from various sources. Many other operating systems may be used, and in certain embodiments a simple set of commands or instructions may function as the operating system. Further, the processor can be designed as a quantum processor designed to perform one or more functions using one or more qubits.

In certain examples, the processor and operating system may together define a platform for which application programs in high-level programming languages may be written. It should be understood that the technology is not limited to a particular system platform, processor, operating system, or network. Also, it should be apparent to those skilled in the art, given the benefit of this disclosure, that the present technology is not limited to a specific programming language or computer system. Further, it should be appreciated that other appropriate programming languages and other appropriate systems could also be used. In certain examples, the hardware or software can be configured to implement cognitive architecture, neural networks or other suitable implementations. If desired, one or more portions of the computer system may be distributed across one or more computer systems coupled to a communications network. These computer systems also may be general-purpose computer systems. For example, various aspects may be distributed among one or more computer systems configured to provide a service (e.g., servers) to one or more client computers, or to perform an overall task as part of a distributed system. For example, various aspects may be performed on a client-server or multi-tier system that includes components distributed among one or more server systems that perform various functions according to various embodiments. These components may be executable, intermediate (e.g., IL) or interpreted (e.g., Java) code which communicate over a communication network (e.g., the Internet) using a communication protocol (e.g., TCP/IP). It should also be appreciated that the technology is not limited to executing on any particular system or group of systems. Also, it should be appreciated that the technology is not limited to any particular distributed architecture, network, or communication protocol.

In some instances, various embodiments may be programmed using an object-oriented programming language, such as, for example, SQL, SmallTalk, Basic, Java, Javascript, PHP, C++, Ada, Python, iOS/Swift, Ruby on Rails or C # (C-Sharp). Other object-oriented programming languages may also be used. Alternatively, functional, scripting, and/or logical programming languages may be used. Various configurations may be implemented in a non-programmed environment (e.g., documents created in HTML, XML or other format that, when viewed in a window of a browser program, render aspects of a graphical-user interface (GUI) or perform other functions). Certain configurations may be implemented as programmed or non-programmed elements, or any combination thereof. In some instances, the systems may comprise a remote interface such as those present on a mobile device, tablet, laptop computer or other portable devices which can communicate through a wired or wireless interface and permit operation of the systems remotely as desired.

In certain examples, the processor may also comprise or have access to a database of information about molecules, their fragmentation patterns, and the like, which can include molecular weights, mass-to-charge ratios and other common information. The instructions stored in the memory can execute a software module or control routine for the system, which in effect can provide a controllable model of the system. The processor can use information accessed from the database together with one or software modules executed in the processor to determine control parameters or values for different components of the systems, e.g., different RF voltages, different mass analyzer parameters, etc. Using input interfaces to receive control instructions and output interfaces linked to different system components in the system, the processor can perform active control over the system. For example, the processor can control the detection device, sample introduction devices, ionization sources and other components of the system.

In certain examples, the rod assemblies described herein can be used in an ion trap to trap ions using the magnetic and RF fields. The ions can be used to improve detection limits, can be stored for later use, e.g., in ion implantation, surface bombardment, as ion standards for mass spectrometry or other applications. For example, the rod assembly can trap the ions in helical or circular paths using the magnetic and RF fields from the rod assembly with the potential addition of supplemental RF fields to the rod assembly, and lenses to reflect ions back into the rod assembly during the storage period. The ion trap may not include any external permanent magnets if desired, which provides an ion trap with fewer components and a smaller footprint.

In certain examples, any two or more of the rods in the rod assemblies described herein can be "coupled" such that the two rods together function as a single rod. For example, two or more rods can receive the same RF voltage so the two rods appear to function as a single larger rod. It may be desirable to group rods together to alter the overall RF field within the ion volume. In some case, three rods can be grouped, four rods can be grouped or more than four rods can be grouped.

In certain embodiments, the ionization sources described herein can be used to ionize analyte molecules. For example, a method of ionizing an analyte comprises introducing the analyte into an ion volume formed from a substantially parallel arrangement of rods of a multipolar rod assembly, wherein the ion volume is configured to receive electrons from an electron source, and wherein the multipolar rod assembly provides a magnetic field and a radio frequency field into the ion volume to increase ionization efficiency of the analyte using the received electrons from the electron source. As noted herein, depending on the field strength used or selected for each of the magnetic and RF fields, the magnetic field can be used to confine or constrain the electrons, and the RF field can be used to confine or constrain the produced ions. In some embodiments, the combination of a magnetic field and RF field can increase ionization efficiency while focusing the produced ions into a more confined or narrow beam or by increasing a number of ions present within a central area of the beam. For example, the magnetic field can primarily constrain the electrons to helical paths near the center of the rods. The RF field can constrain the ions to oscillations around the center of the rods. A lens at the exit of the rods can, depending on the voltage, reflect electrons back into the rods, where they can again be reflected by a lens (repeller) between the filament and the ion volume, thus producing multiple reflections of the electrons and increasing their net density in the ion volume. In some examples, an RF Voltage used to constrain the ions may vary from about 20 Volts to about 3500 Volts. The voltage can be an AC voltage or a DC voltage or an AC voltage can be provided to certain rods and a DC voltage can be provided to other rods. In some examples, the voltage is a RF voltage with a frequency that may vary from about 100 kHz to about 3 MHz.

In some embodiments, different magnetized materials or magnetizable materials can be used to ionize and/or focus the ions/electrons. For example, different rods can be produced with different magnetizable materials to alter the overall shape of the magnetic field within the ionization source.

In some examples, the ionization sources described herein may also be configured as chemical ionization sources. For example, a chemical ionization source may comprise a gas source, an electron source and a multipolar rod assembly as described herein. The electrons can be used to ionize the gas of the gas source, and the ionized gas can then be used to ionize analyte molecules. Illustrative chemical ionization gases include, but are not limited to, ammonia, methane, isobutene or other materials. In addition, at a high enough pressures helium or another inert gas may also be used as chemical ionization gases, since the ions can be trapped in the ion source for a prolonged period of time.

When introducing elements of the examples disclosed herein, the articles "a," "an," "the" and "said" are intended to mean that there are one or more of the elements. The terms "comprising," "including" and "having" are intended to be open-ended and mean that there may be additional elements other than the listed elements. It will be recognized by the person of ordinary skill in the art, given the benefit of this disclosure, that various components of the examples can be interchanged or substituted with various components in other examples.

Although certain aspects, examples and embodiments have been described above, it will be recognized by the person of ordinary skill in the art, given the benefit of this disclosure, that additions, substitutions, modifications, and alterations of the disclosed illustrative aspects, examples and embodiments are possible.

What is claimed is:

1. An ionization source comprising:

a multipolar rod assembly configured to provide each of a magnetic field and a radio frequency field from the multipolar rod assembly, wherein the magnetic field and the radio frequency field are provided from the multipolar rod assembly into an ion volume formed by a substantially parallel arrangement of rods of the multipolar rod assembly;

an electron source configured to provide electrons into the ion volume of the multipolar rod assembly to ionize analyte introduced into the ion volume; and an electron reflector arranged co-linearly with the electron source and configured to receive electrons from the electron source.

2. The ionization source of claim 1, further comprising an enclosure surrounding or within the multipolar rod assembly, wherein the enclosure comprises an aperture fluidically coupled to the electron source at an inlet to permit the electrons from the electron source to enter into the ion volume through the inlet.

3. The ionization source of claim 1, further comprising an ionization block comprising an entrance aperture and an exit aperture, wherein a longitudinal axis of each rod of the multipolar rod assembly is substantially parallel with a longitudinal axis of the ionization block, and wherein the entrance aperture is fluidic ally coupled to the ion volume to permit introduction of electrons through the entrance aperture and into the ion volume to ionize analyte within the ion volume, and wherein the exit aperture is configured to permit exit of ionized analyte from the ionization block.

4. The ionization source of claim 1, further comprising an electron repeller arranged co-linearly with the electron source.

5. The ionization source of claim 1, wherein the multipolar rod assembly comprises at least four rods.

6. The ionization source of claim 1, wherein the multipolar rod assembly comprises one of a quadrupolar rod assembly, a hexapolar rod assembly, an octopolar rod assembly, a decapolar rod assembly or a dodecapolar rod assembly.

7. The ionization source of claim 1, wherein each rod of the multipolar rod assembly comprises a magnetizable material, and wherein each rod is magnetized and provides a similar field strength.

8. The ionization source of claim 1, wherein each rod of the multipolar rod assembly comprises a magnetizable material, and wherein at least one rod of the multipolar assembly provides a different field strength than another rod of the multipolar assembly when the at least one rod and the another rod are magnetized.

9. The ionization source of claim 1, wherein the multipolar rod assembly comprises a plurality of rods, wherein the multipolar rod assembly is configured to operate in a quadrupolar mode using four of the plurality of rods, wherein the multipolar rod assembly is configured to operate in a hexapolar mode using six of the plurality of rods, and wherein the multipolar rod assembly is configured to operate in an octopolar mode using eight of the plurality of rods.

10. The ionization source of claim 1, wherein at least one rod of the multipolar assembly comprises a different length than another rod of the multipolar assembly or is non-parallel to another rod of the multipolar rod assembly.

11. The ionization source of claim 1, wherein a cross-sectional width of at least one rod of the multipolar rod assembly varies along a length of the at least one rod.

12. The ionization source of claim 1, wherein a shape of each rod of the multipolar rod assembly is independently conical, round, tapered, square, rectangular, triangular, trapezoidal, parabolic, hyperbolic or other geometric shape.

13. The ionization source of claim 12, wherein at least two rods of the multipolar rod assembly comprise different shapes.

14. A mass spectrometer comprising:

an ionization source comprising:

a multipolar rod assembly configured to provide each of a magnetic field and a radio frequency field from the multipolar rod assembly, wherein the magnetic field and the radio frequency field are provided from the multipolar rod assembly into an ion volume formed by a substantially parallel arrangement of rods of the multipolar rod assembly, an electron source fluidically coupled to the ion volume of the multipolar rod assembly to provide electrons from the electron source into the ion volume to ionize analyte introduced into the ion volume, and an electron reflector arranged co-linearly with the electron source and configured to receive electrons from the electron source; and a mass analyzer fluidically coupled to the ion volume and configured to receive ionized analyte exiting the ion volume.

15. The mass spectrometer of claim 14, further comprising a processor electrically coupled to a power source, wherein the processor is configured to provide a radio frequency voltage to rods of the multipolar rod assembly from the power source to provide the radio frequency field.

16. The mass spectrometer of claim 15, wherein the processor is further configured to provide a DC voltage to rods of the multipolar rod assembly.

17. The mass spectrometer of claim 15, wherein the processor provides the radio frequency voltage to four rods of the multipolar assembly in a quadrupolar mode, to six rods of the multipolar assembly in a hexapolar mode, and to eight rods of the multipolar assembly in an octopolar mode.

18. An ionization source comprising:

a multipolar rod assembly configured to provide each of a magnetic field and a radio frequency field from the multipolar rod assembly, wherein the magnetic field and the radio frequency field are provided from the multipolar rod assembly into an ion volume formed by a substantially parallel arrangement of rods of the multipolar rod assembly, wherein each rod of the multipolar rod assembly comprises a magnetizable material, and wherein each rod is magnetized and provides a similar field strength; and an electron source configured to provide electrons into the ion volume of the multipolar rod assembly to ionize analyte introduced into the ion volume.

19. The ionization source of claim 18, further comprising an enclosure surrounding or within the multipolar rod assembly, wherein the enclosure comprises an aperture fluidically coupled to the electron source at an inlet to permit the electrons from the electron source to enter into the ion volume through the inlet.

20. The ionization source of claim 18, further comprising an ionization block comprising an entrance aperture and an exit aperture, wherein a longitudinal axis of each rod of the multipolar rod assembly is substantially parallel with a longitudinal axis of the ionization block, and wherein the entrance aperture is fluidically coupled to the ion volume to permit introduction of electrons through the entrance aperture and into the ion volume to ionize analyte within the ion volume, and wherein the exit aperture is configured to permit exit of ionized analyte from the ionization block.

21. The ionization source of claim 18, further comprising an electron repeller arranged co-linearly with the electron source.

22. The ionization source of claim 18, wherein the multipolar rod assembly comprises one of a quadrupolar rod assembly, a hexapolar rod assembly, an octopolar rod assembly, a decapolar rod assembly or a dodecapolar rod assembly.

23. The ionization source of claim 18, wherein the multipolar rod assembly comprises a plurality of rods, wherein the multipolar rod assembly is configured to operate in a quadrupolar mode using four of the plurality of rods, wherein the multipolar rod assembly is configured to operate in a hexapolar mode using six of the plurality of rods, and wherein the multipolar rod assembly is configured to operate in an octopolar mode using eight of the plurality of rods.

24. The ionization source of claim 18, wherein at least one rod of the multipolar assembly comprises a different length than another rod of the multipolar assembly or is non-parallel to another rod of the multipolar rod assembly.

25. The ionization source of claim 18, wherein a cross-sectional width of at least one rod of the multipolar rod assembly varies along a length of the at least one rod.

26. The ionization source of claim 18, wherein a shape of each rod of the multipolar rod assembly is independently conical, round, tapered, square, rectangular, triangular, trapezoidal, parabolic, hyperbolic or other geometric shape.

27. An ionization source comprising:

a multipolar rod assembly configured to provide each of a magnetic field and a radio frequency field from the multipolar rod assembly, wherein the magnetic field and the radio frequency field are provided from the multipolar rod assembly into an ion volume formed by a substantially parallel arrangement of rods of the multipolar rod assembly, wherein each rod of the multipolar rod assembly comprises a magnetizable material, and wherein at least one rod of the multipolar assembly provides a different field strength than another rod of the multipolar assembly when the at least one rod and the another rod are magnetized; and an electron source configured to provide electrons into the ion volume of the multipolar rod assembly to ionize analyte introduced into the ion volume.

28. The ionization source of claim 27, further comprising an enclosure surrounding or within the multipolar rod assembly, wherein the enclosure comprises an aperture fluidically coupled to the electron source at an inlet to permit the electrons from the electron source to enter into the ion volume through the inlet.

29. The ionization source of claim 27, further comprising an ionization block comprising an entrance aperture and an exit aperture, wherein a longitudinal axis of each rod of the multipolar rod assembly is substantially parallel with a longitudinal axis of the ionization block, and wherein the entrance aperture is fluidically coupled to the ion volume to permit introduction of electrons through the entrance aperture and into the ion volume to ionize analyte within the ion volume, and wherein the exit aperture is configured to permit exit of ionized analyte from the ionization block.

30. The ionization source of claim 27, further comprising an electron repeller arranged co-linearly with the electron source.

31. The ionization source of claim 27, wherein the multipolar rod assembly comprises one of a quadrupolar rod assembly, a hexapolar rod assembly, an octopolar rod assembly, a decapolar rod assembly or a dodecapolar rod assembly.

32. The ionization source of claim 27, wherein the multipolar rod assembly comprises a plurality of rods, wherein the multipolar rod assembly is configured to operate in a quadrupolar mode using four of the plurality of rods, wherein the multipolar rod assembly is configured to operate in a hexapolar mode using six of the plurality of rods, and wherein the multipolar rod assembly is configured to operate in an octopolar mode using eight of the plurality of rods.

33. The ionization source of claim 27, wherein at least one rod of the multipolar assembly comprises a different length than another rod of the multipolar assembly or is non-parallel to another rod of the multipolar rod assembly.

34. The ionization source of claim 27, wherein a cross-sectional width of at least one rod of the multipolar rod assembly varies along a length of the at least one rod.

35. The ionization source of claim 27, wherein a shape of each rod of the multipolar rod assembly is independently conical, round, tapered, square, rectangular, triangular, trapezoidal, parabolic, hyperbolic or other geometric shape.

* * * * *